US010847884B2

(12) United States Patent
Chou et al.

(10) Patent No.: US 10,847,884 B2
(45) Date of Patent: Nov. 24, 2020

(54) MULTI-FREQUENCY ANTENNA DEVICE

(71) Applicant: Unictron Technologies Corporation, Hsin-Chu (TW)

(72) Inventors: Chih-Shen Chou, Miaoli County (TW); Tsung-Shou Yeh, Hsinchu County (TW); Hsiang-Cheng Yang, Taoyuan (TW); Ching-Ling Lu, Hsinchu (TW)

(73) Assignee: Unictron Technologies Corporation, Hsin-Chu (TW)

( * ) Notice: Subject to any disclaimer, the term of this patent is extended or adjusted under 35 U.S.C. 154(b) by 36 days.

(21) Appl. No.: 16/388,792

(22) Filed: Apr. 18, 2019

(65) Prior Publication Data

US 2019/0334239 A1 Oct. 31, 2019

(30) Foreign Application Priority Data

Apr. 27, 2018 (TW) ..... 107205495 U

(51) Int. Cl.

| | |
|---|---|
| ***H01Q 1/24*** | (2006.01) |
| ***H01Q 1/38*** | (2006.01) |
| ***H01Q 5/371*** | (2015.01) |
| ***H01Q 5/50*** | (2015.01) |
| ***H01Q 21/06*** | (2006.01) |
| ***H01Q 13/10*** | (2006.01) |

(52) U.S. Cl.

CPC ..... *H01Q 5/371* (2015.01); *H01Q 1/24* (2013.01); *H01Q 1/38* (2013.01); *H01Q 5/50* (2015.01); *H01Q 13/106* (2013.01); *H01Q 21/065* (2013.01)

(58) Field of Classification Search

CPC ..... H01Q 1/38; H01Q 1/243; H01Q 5/371; H01Q 5/378; H01Q 9/0407; H01Q 5/357; H01Q 19/005; H01Q 21/065; H01Q 25/00; H01Q 5/321; H01Q 5/392; H01Q 5/50; H01Q 9/065

See application file for complete search history.

(56) References Cited

U.S. PATENT DOCUMENTS 6,836,247 B2 * 12/2004 Soutiaguine ..... H01Q 9/0414 343/700 MS
6,876,328 B2 * 4/2005 Adachi ..... H01Q 1/243 343/700 MS (Continued)

*Primary Examiner* — Vibol Tan
(74) *Attorney, Agent, or Firm* — Winston Hsu

(57) ABSTRACT

The present invention is a multi-frequency antenna device comprising a first electrode layer and a second electrode layer disposed on a first surface of an insulating substrate, wherein the second electrode layer is located outside periphery of the first electrode layer. A third electrode layer is disposed on a second surface of the insulating substrate, and the first surface and the second surface are separated by the insulating substrate. A conductive element penetrates the insulating substrate and is connected to the first electrode layer. A groove is disposed on a side surface and/or the second surface of the insulating substrate, and a projection of the groove on the first surface completely or partially overlaps the second electrode layer. An effective dielectric constant between the second electrode layer and the third electrode layer is changed through arrangement of the groove to adjust a resonance frequency generated by the second electrode layer.

20 Claims, 23 Drawing Sheets

(56) References Cited

U.S. PATENT DOCUMENTS

| | | | | |
|---|---|---|---|---|
| 7,164,385 | B2 * | 1/2007 | Duzdar | H01Q 9/0428 343/700 MS |
| 8,514,146 | B2 * | 8/2013 | Gummalla | H01Q 1/38 343/909 |
| 8,674,884 | B2 * | 3/2014 | Lin | H01Q 9/0428 340/10.4 |
| 8,830,128 | B2 * | 9/2014 | Fuchs | H01Q 1/38 343/700 MS |
| 9,225,066 | B2 * | 12/2015 | Chou | H01Q 9/0457 |
| 9,288,894 | B2 * | 3/2016 | Shimasaki | H05K 1/0225 |
| 9,887,465 | B2 * | 2/2018 | Gummalla | H01Q 1/38 |

* cited by examiner

MULTI-FREQUENCY ANTENNA DEVICE

BACKGROUND OF THE INVENTION

1. Field of the Invention

The present invention is related to a multi-frequency antenna device, which comprises at least one groove disposed on an insulating substrate having at least one electrode layer, to thereby change an effective dielectric constant of the media between a second electrode layer and a third electrode layer and achieve the purpose of adjusting one or more resonance frequencies generated or formed by the associated electrode layers.

2. Description of the Prior Art

In comparison with the other antennas, a microstrip antenna can be configured to produce a circular polarization antenna, and has advantages such as planar shape, being suitable for mass production and feasible to be integrated into an active component or a circuit board, etc., and is therefore widely applied to various types of wireless communication devices; for example, global positioning systems (GPS) or wireless radio frequency (RF) identification (RFID).

Please refer to FIG. 1, which is a stereoscopic perspective diagram illustrating a microstrip antenna 10 of a related art. As shown in FIG. 1, the microstrip antenna 10 of the related art comprises an insulating substrate 11, a first conductive layer 13, a second conductive layer 15 and a conductive element 171, where the first conductive layer 13 is located on an upper surface of the insulating substrate 11, and the second conductive layer 15 is located on a lower surface of the insulating substrate 11. The conductive element 171 penetrates the insulating substrate 11, the first conductive layer 13 and the second conductive layer 15, and is electrically connected to the first conductive layer 13.

The first conductive layer 13 disposed on the upper surface of the insulating substrate 11 may serve as a radiator of the microstrip antenna 10, and the second conductive layer 15 disposed on the lower surface of the insulating substrate 11 may serve as the ground plane. When the microstrip antenna 10 receives a wireless RF signal, the wireless RF signal maybe inputted through the conductive element 171 from the first conductive layer 13, and when the microstrip antenna 10 transmits a wireless RF signal, this signal may be transmitted to the first conductive layer 13 through the conductive element 171 and emitted by the first conductive layer 13.

A frequency of a wireless RF signal that can be received or transmitted by the microstrip antenna 10 is associated with the length and the width of the first conductive layer 13, and is also associated with a dielectric constant of the insulating substrate 11. In order to produce the microstrip antenna 10 having lower resonance frequency, the length and the width of the first conductive layer 13 needs to be increased, and therefore, the size and the manufacturing costs of the microstrip antenna 10 will be increased. The insulating substrate 11 with a greater dielectric constant can be used for producing the microstrip antenna 10 to reduce the resonance frequency of the microstrip antenna 10, where this method can prevent the size of the microstrip 10 from being increased, but the costs of the microstrip 10 is still increased. After a size and a dielectric constant of an insulating substrate are determined, a resonance frequency that maybe generated by the microstrip antenna is basically fixed. Thus, when a microstrip antenna having two resonance frequencies is manufactured on an insulating substrate, it is not easy to accurately and effectively adjust the two resonance frequencies concurrently.

SUMMARY OF THE INVENTION

The present invention provides a multi-frequency antenna device. The multi-frequency antenna device comprises a first electrode layer and a second electrode layer disposed on an first surface of an insulating substrate, and comprises a third electrode layer disposed on a second surface of the insulating substrate, where the second electrode layer is located outside of a periphery of the first electrode layer without contacting the first electrode layer. At least one groove may be disposed on a side surface and/or the second surface of the insulating substrate, and the groove completely or partially overlaps the second electrode layer. The first electrode layer and the second electrode layer may be arranged to generate different resonance frequencies, respectively, and an effective dielectric constant between the second electrode layer and the third electrode layer can be changed by arrangement of the groove, to thereby adjust the resonance frequency generated by the second electrode layer.

The present invention provides a multi-frequency antenna device. The multi-frequency antenna device comprises at least one groove disposed on a side surface and/or a second surface of an insulating substrate and/or inside of the insulating substrate, and makes a projection of the groove on the first surface partially overlaps an electrode layer of the insulating substrate. Additionally, the overlapping area between the projection of the groove on the first surface and the electrode layer, and/or vertical depth of the groove and/or arrangement location(s) of the groove, can be adjusted to change the resonance frequency generated by the electrode layer.

The present invention provides a multi-frequency antenna device. The multi-frequency antenna device comprises: an insulating substrate comprising at least one first hole, a first surface, a second surface and at least one side surface, wherein the first surface and the second surface are opposite surfaces separated by the insulating substrate, the first surface is connected with the second surface through the side surface, and the first hole penetrates the insulating substrate; at least one first electrode layer, disposed on the first surface of the insulating substrate; at least one second electrode layer, disposed on the first surface of the insulating substrate, located outside of a periphery of the first electrode layer without contacting the first electrode layer; at least one third electrode layer, disposed on the second surface of the insulating substrate; at least one conductive element, penetrating the first hole and electrically connected to the first electrode layer without contacting the third electrode layer; and at least one groove, disposed on the side surface and/or the second surface, wherein a projection of the groove on the first surface completely or partially overlaps the second electrode layer, wherein the first electrode layer is arranged to generate a first resonance frequency, the second electrode layer is arranged to generate a second resonance frequency, and the first resonance frequency is higher than the second resonance frequency.

The present invention provides another multi-frequency antenna device. The multi-frequency antenna device comprises: an insulating substrate comprising at least one first hole, a first surface and a second surface, wherein the first surface and the second surface are opposite surfaces separated by the insulating substrate, and the first hole penetrates the insulating substrate; at least one first electrode layer, disposed on the first surface of the insulating substrate; at least one second electrode layer, disposed on the first surface of the insulating substrate, located outside of a periphery of the first electrode layer without contacting the first electrode layer; at least one third electrode layer, disposed on the second surface of the insulating substrate; a carrier substrate, comprising at least one second hole, a third surface, a fourth surface and at least one side surface, wherein the third surface and the fourth surface are opposite surfaces separated by the carrier substrate, the third surface is connected with the fourth surface through the side surface of the carrier substrate, and the second hole penetrates the carrier substrate, wherein the third surface completely or partially adheres to the second surface of the insulating substrate, and the second hole is connected to the first hole of the insulating substrate; at least one conductive element, penetrating the first hole and the second hole and electrically connected to the first electrode layer without contacting the third electrode layer; and at least one groove, disposed on at least one side surface and/or the second surface of the insulating substrate, and/or disposed on the side surface, the third surface and/or the fourth surface of the carrier substrate, wherein a projection of the groove on the first surface completely or partially overlaps the second electrode layer, wherein the first electrode layer is arranged to generate a first resonance frequency, the second electrode layer is arranged to generate a second resonance frequency, and the first resonance frequency is higher than the second resonance frequency.

The present invention further provides a multi-frequency antenna device. The multi-frequency antenna device comprises: an insulating substrate comprising at least one first hole, a first surface, a second surface and at least one side surface, wherein the first surface and the second surface are opposite surfaces separated by the insulating substrate, the first surface is connected with the second surface through the side surface, and the first hole penetrates the insulating substrate; at least one first electrode layer, disposed on the first surface of the insulating substrate; at least one second electrode layer, disposed on the first surface of the insulating substrate, located outside of a periphery of the first electrode layer; a carrier substrate, comprising at least one second hole, a third surface, a fourth surface and at least one side surface, wherein the third surface and the fourth surface are opposite surfaces separated by the carrier substrate, the third surface is connected with the fourth surface through the side surface of the carrier substrate, and the second hole penetrates the carrier substrate, wherein the third surface completely or partially adheres to the second surface of the insulating substrate, and the second hole is connected to the first hole of the insulating substrate; at least one conductive element, penetrating the first hole and the second hole and electrically connected to the first electrode layer; and at least one groove, disposed on the side surface and/or the second surface of the insulating substrate, and/or disposed on the side surface, the third surface and/or the fourth surface of the carrier substrate, wherein a projection of the groove on the first surface completely or partially overlaps the second electrode layer, wherein the first electrode layer is arranged to generate a first resonance frequency, the second electrode layer is arranged to generate a second resonance frequency, and the first resonance frequency is higher than the second resonance frequency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
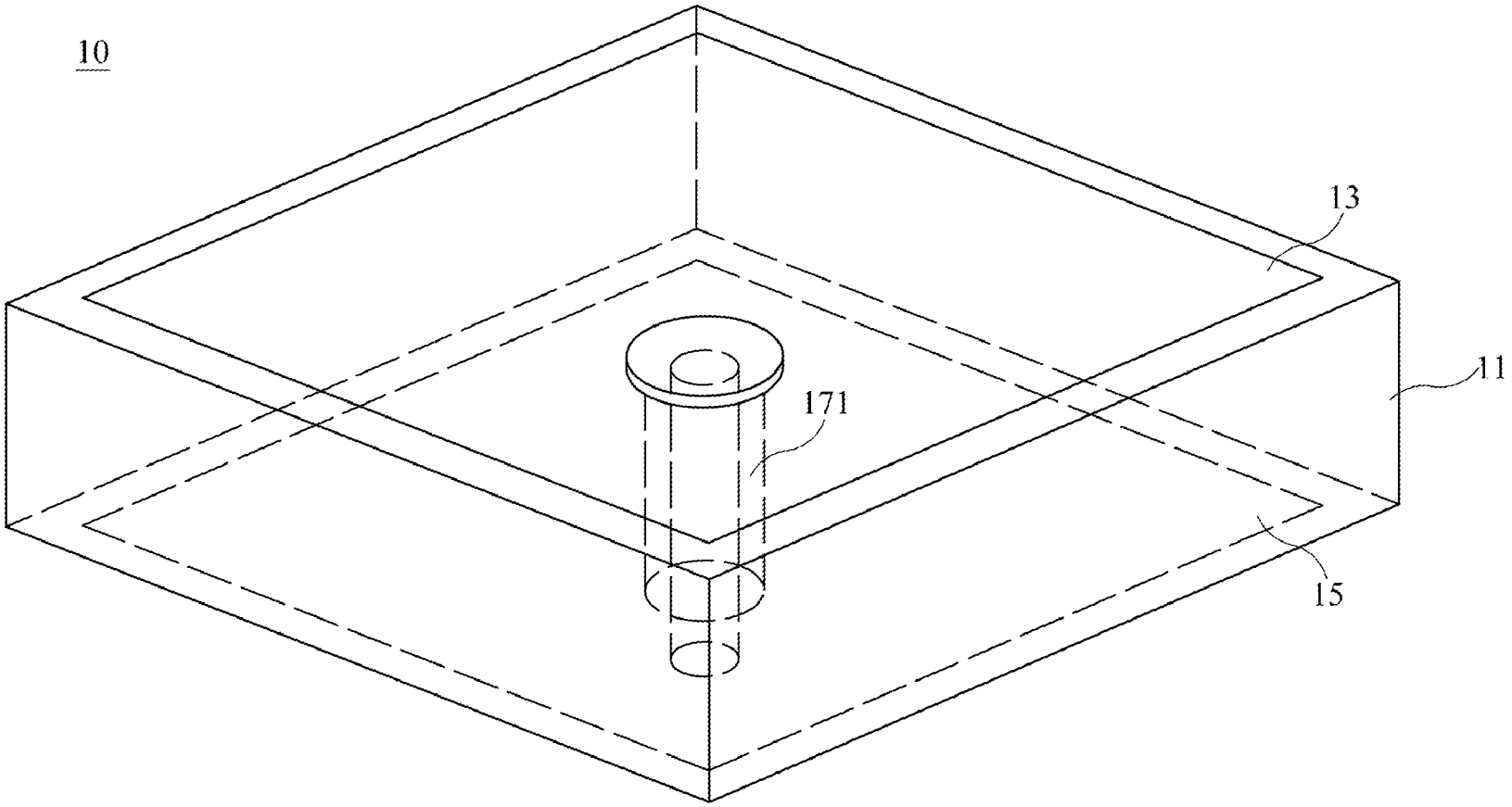
FIG. 1 PRIOR ART
FIG. 1 is a stereoscopic perspective diagram illustrating a microstrip antenna of the related art.
Figure 2:
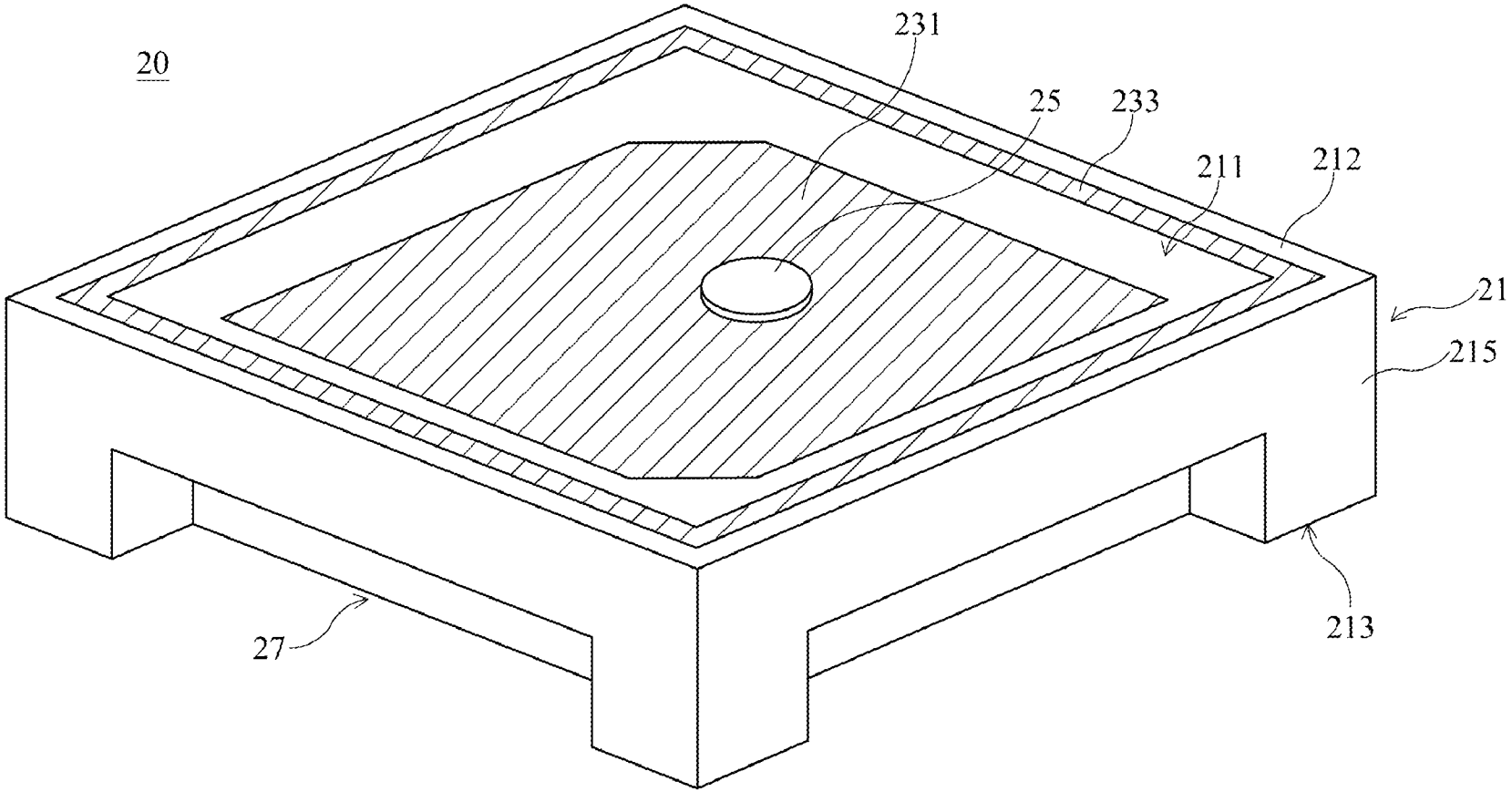
FIG. 2 is a stereoscopic diagram illustrating top of a multi-frequency antenna device according to an embodiment of the present invention.
Figure 3:
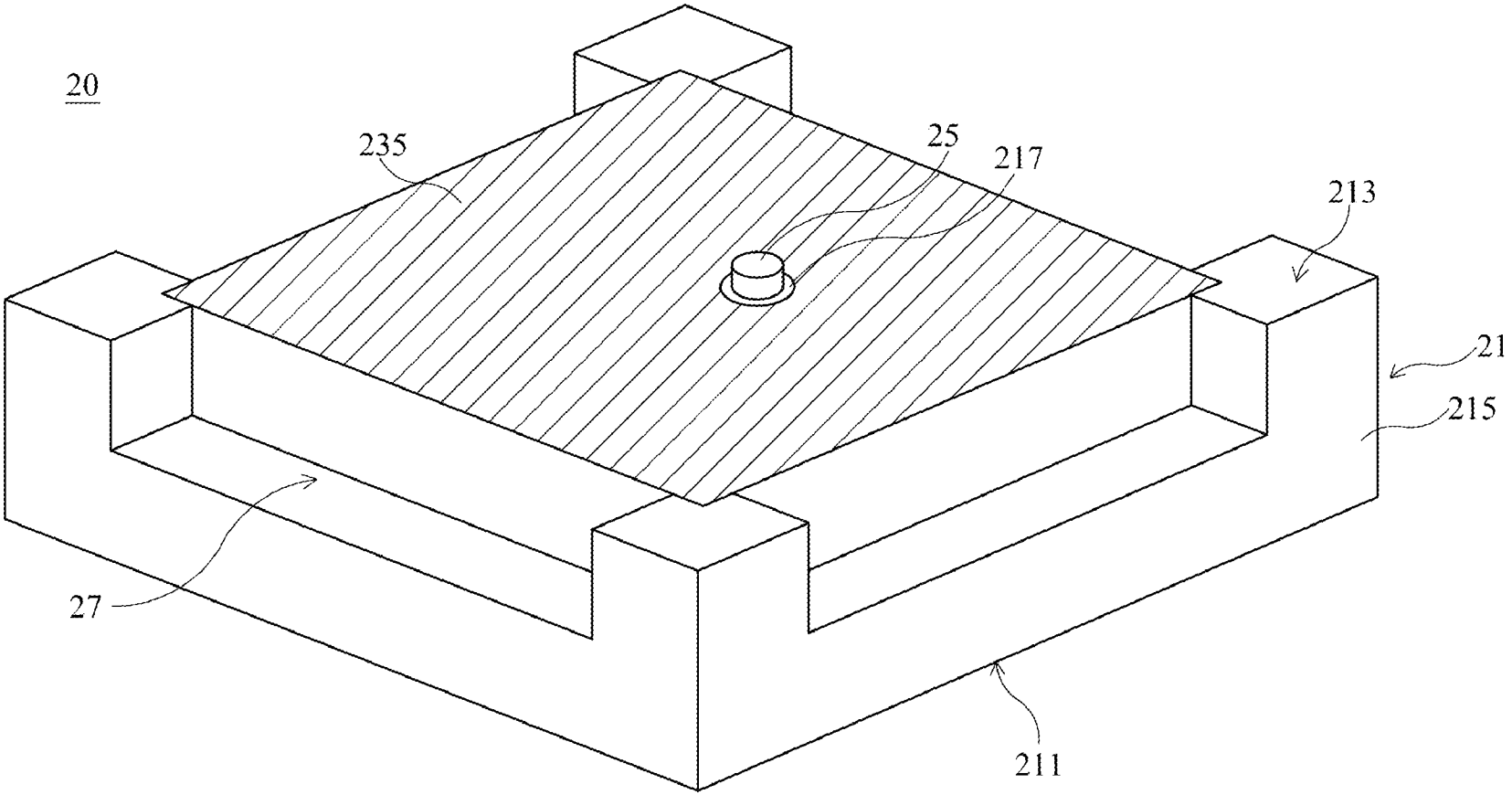
FIG. 3 is a stereoscopic diagram illustrating bottom of a multi-frequency antenna device according to an embodiment of the present invention.

Please refer to FIG. 2 and FIG. 3, which are stereoscopic diagrams respectively illustrating top and bottom of a multi-frequency antenna device 20 according to an embodiment of the present invention. As shown in FIGS. 2 and 3, the multi-frequency antenna device 20 mainly comprises an insulating substrate 21, at least one first electrode layer 231, at least one second electrode layer 233, at least one third electrode layer 235, at least one conductive element 25 and at least one groove 27.

The insulating substrate 21 comprises a first surface 211, a second surface 213, at least one side surface 215 and at least one first hole 217, where the first surface 211 and the second surface 213 are opposite surfaces separated by the insulating substrate 21; for example, the first surface 211 is a top surface, and the second surface 213 is a bottom surface. Additionally, the first surface 211 is connected with the second surface 213 through the side surface 215; for example, the insulating substrate 21 maybe a polygonal prism or a cylinder. The first hole 217 penetrates the insulating substrate 21; for example, the first hole 217 links up the first surface 211 and the second surface 213 of the insulating substrate 21.

The first electrode layer 231 and the second electrode layer 233 are disposed on the first surface 211 of the insulating substrate 21, where the second electrode layer 233 is located outside of a periphery of the first electrode layer 231 without contacting the first electrode layer 231.

Figure 4:
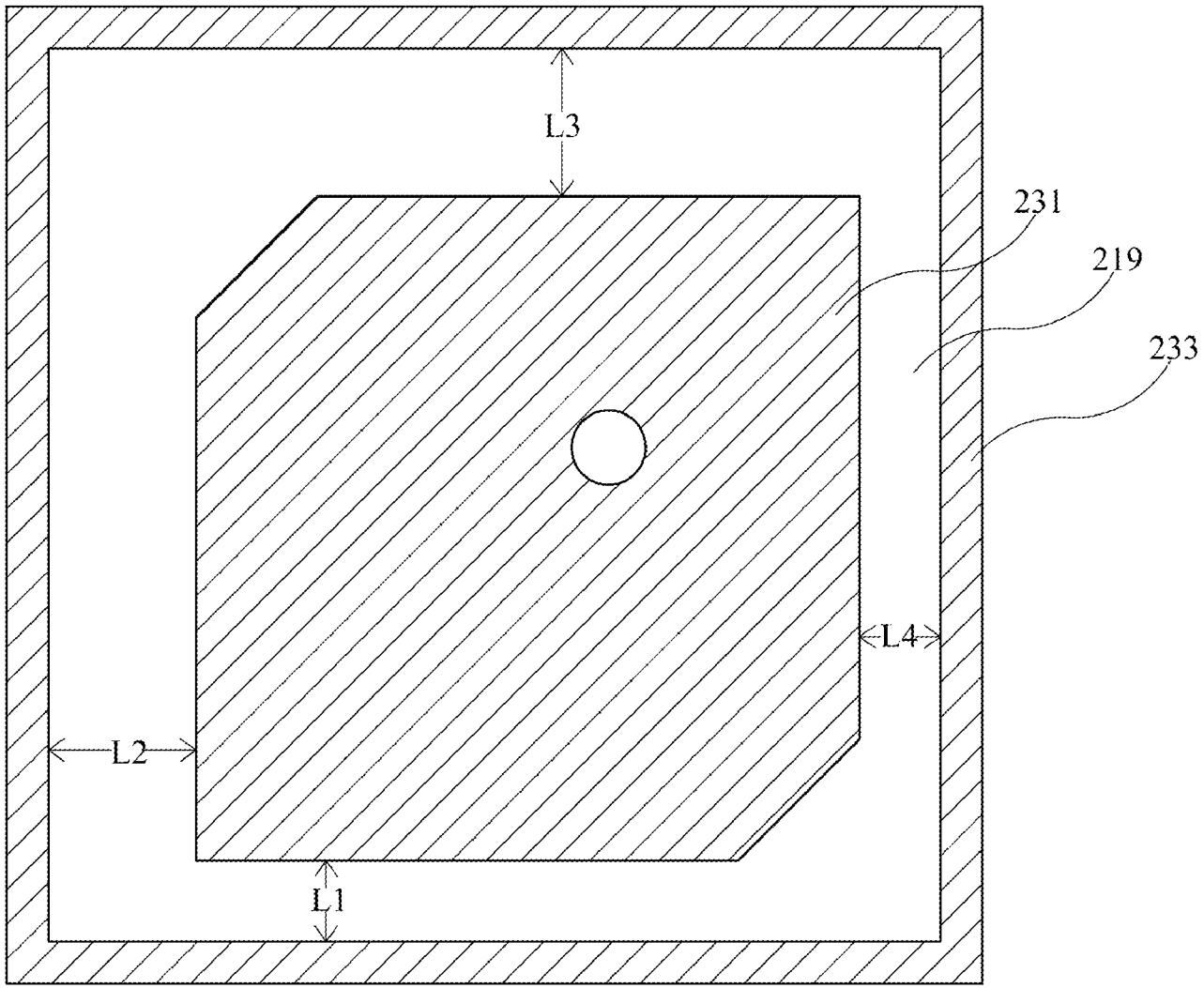
FIG. 4 is a top view of a multi-frequency antenna device according to an embodiment of the present invention.
Figure 6:
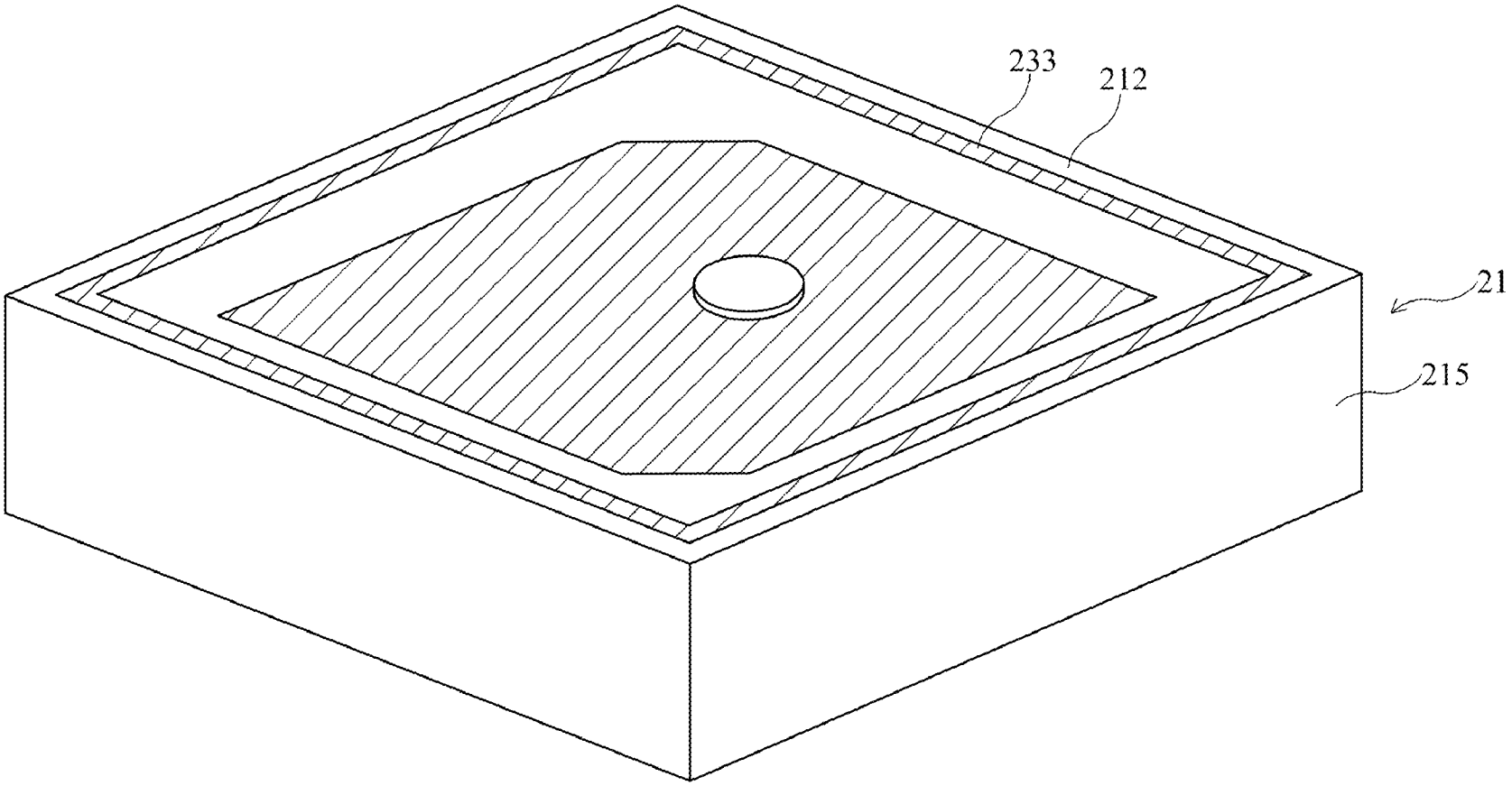
FIG. 6 is a stereoscopic diagram illustrating top of a multi-frequency antenna device according to another embodiment of the present invention.

In an embodiment of the present invention, the second electrode layer 233 may be disposed tightly along the side surfaces 215 (e.g. respective side surfaces) of the insulating substrate 21 as shown in FIG. 4. In different embodiments, as shown in FIG. 2 and FIG. 6, a gap 212 may exist between the second electrode layer 233 and the side surfaces 215, so that the second electrode layer 233 is not disposed tightly along the side surfaces 215 of the insulating substrate.

Figure 5:
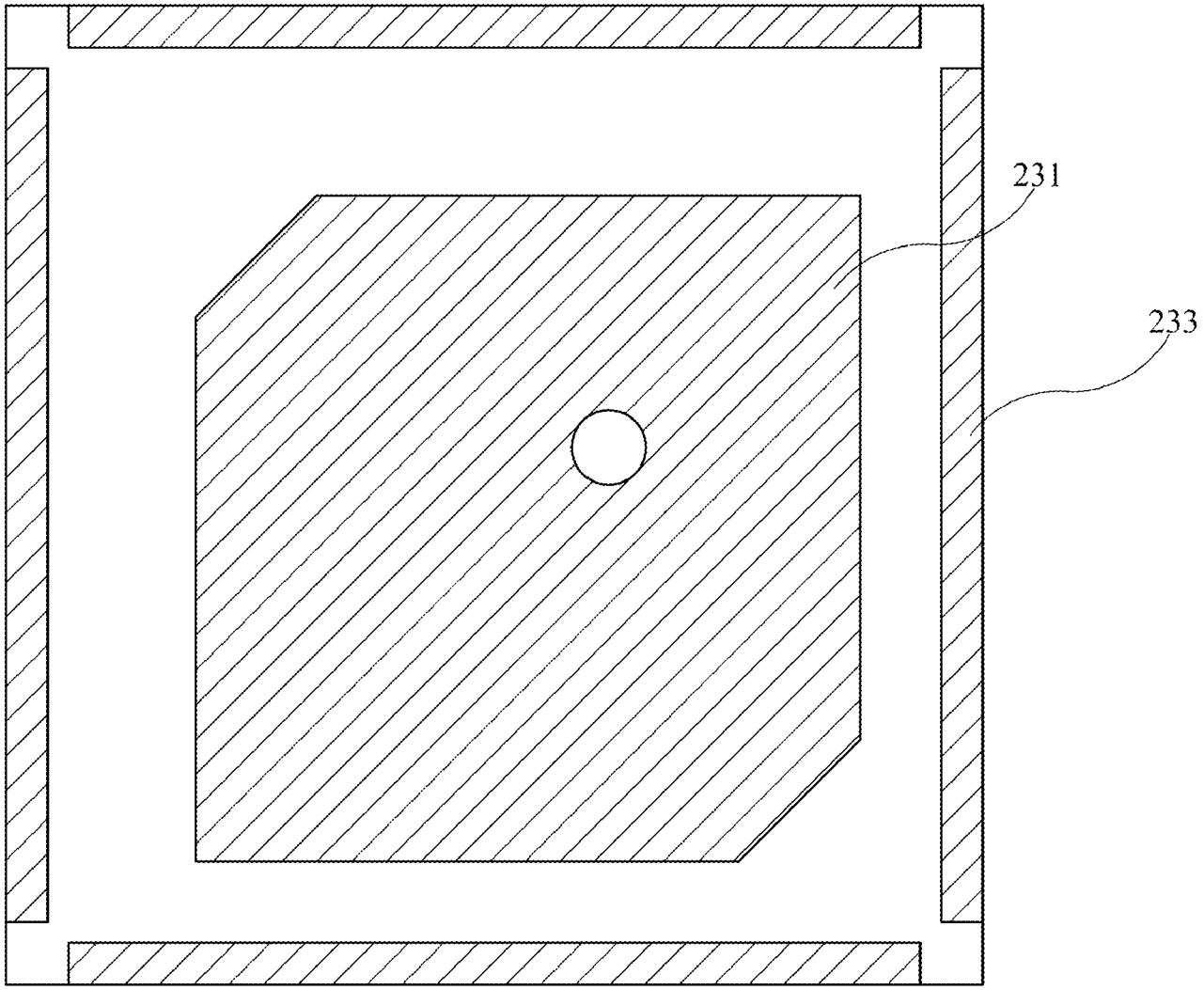
FIG. 5 is a top view of a multi-frequency antenna device according to another embodiment of the present invention.

In an embodiment of the present invention, the number of the second electrode layer 233 is one, where the second electrode layer 233 may be a continuous ring structure, and is disposed to surround the first electrode layer 231 as shown in FIG. 4. For example, the second electrode layer 233 is a ring structure, and is able to form a disposing region 219 on the first surface 211 of the insulating substrate 21, where the disposing region 219 is an internal region surrounded by the second electrode layer 233, and the first electrode layer 231 is disposed in the disposing region 219. In another embodiment of the present invention, the number of the second electrode layers 233 is plural, and the plurality of the second electrode layers 233 are disposed outside of the periphery of the first electrode layer 231 as shown in FIG. 5.

In an embodiment of the present invention as shown in FIG. 4, the first electrode layer 231 does not have to be disposed on the middle or the center of the disposing region 219, that is, may be disposed on a location biased toward a certain side or a certain corner of the disposing region 219. For example, the first electrode layer 231 may be a polygon having four or more sides, where there are respective intervals (e.g. gaps) between four relative large sides of the first electrode layer 231 and four adjacent sides of the second electrode layer 233. Within these intervals between the four relative large sides of the first electrode layer 231 and the four adjacent sides of the second electrode layer 233, the smallest interval is a first interval L1, and the other intervals sequentially arranged in the clockwise direction are a second interval L2, a third interval L3 and a fourth interval L4, where the first interval L1 is not equal to the third interval L3, and the second interval L2 is not equal to the fourth interval L4.

Figure 7:
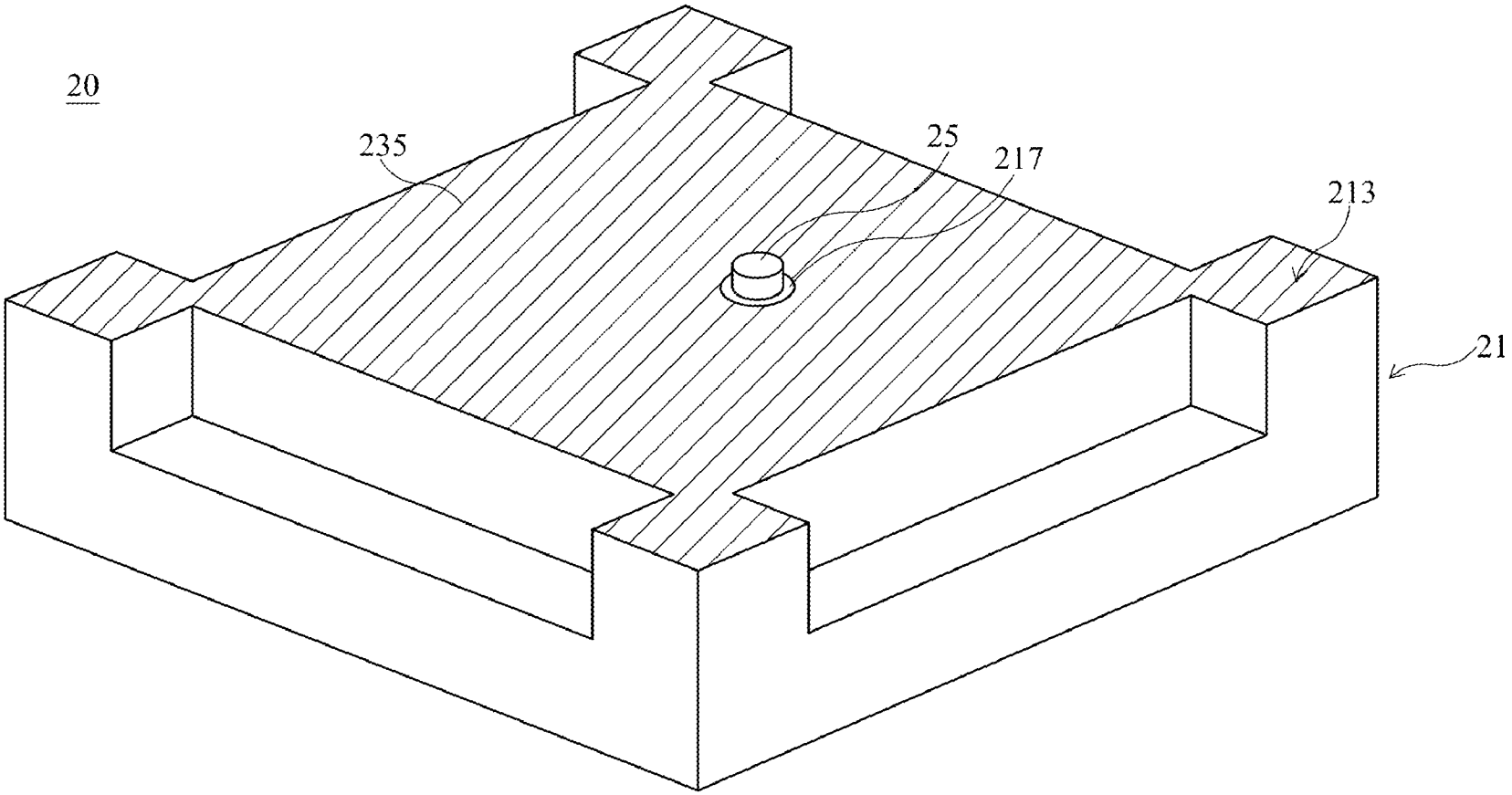
FIG. 7 is a stereoscopic diagram illustrating bottom of a multi-frequency antenna device according to another embodiment of the present invention.

The third electrode layer 235 is disposed on a partial region of the second surface 213 of the insulating substrate 21 as shown in FIG. 3, or disposed on the whole region of the second surface 213 of the insulating substrate 21 as shown in FIG. 7, where the third electrode layer 235 is an opposite surface of the first electrode layer 231 and/or the second electrode layer 233 separated by the insulating substrate 21. The conductive element 25 penetrates the first hole 217 on the insulating substrate 21, and is electrically connected to the first electrode layer 231 without contacting the third electrode layer 235.

More specifically, the first electrode layer 231 and/or the third electrode layer 235 respectively have holes disposed thereon, where the holes disposed on the first electrode layer 231 and the third electrode layer 235 of the insulating substrate 21 partially or completely overlap the locations of the first hole 217 on the insulating substrate 21. A cross-sectional area of the conductive element 25 is less than a cross-sectional area of the first hole 217 of the insulating substrate 21, which allows the conductive element 25 to be put into the first hole 217 of the insulating substrate 21. In an embodiment of the present invention, a terminal of the conductive element 25 may be connected to the first electrode layer 231, and another terminal of the conductive element 25 is electrically connected to a signal feed-in terminal (not shown).

The first electrode layer 231 is arranged to generate a first resonance frequency, and the second electrode layer 233 is arranged to generate a second resonance frequency, where the first resonance frequency is higher than the second resonance frequency.

Figure 8:
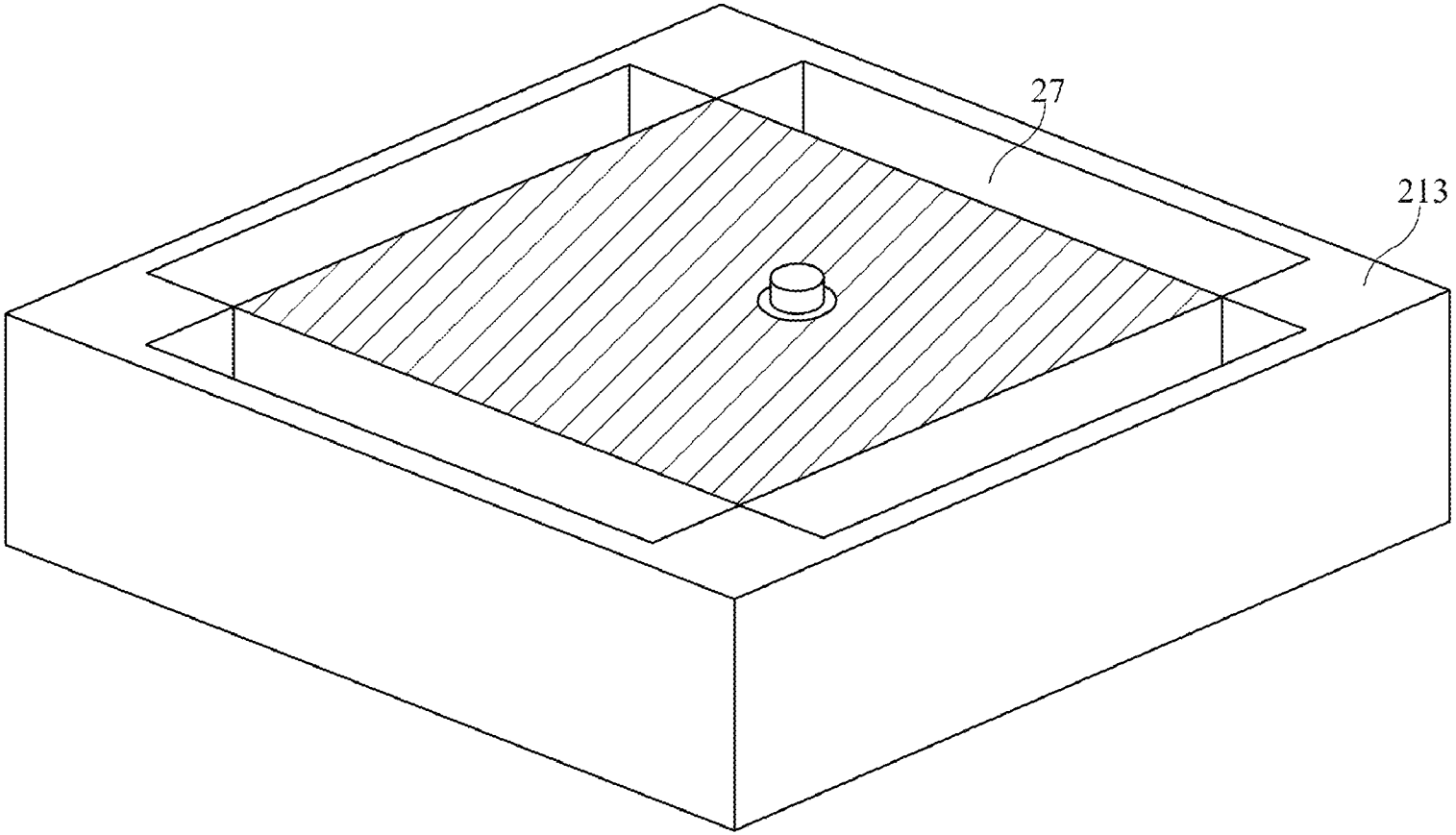
FIG. 8 is a stereoscopic diagram illustrating bottom of a multi-frequency antenna device according to another embodiment of the present invention.

The groove 27 is disposed on the side surface 215 and/or the second surface 213 of the insulating substrate 21, where a projection of the groove 27 on the first surface 211 completely or partially overlaps the second electrode layer 233. In an embodiment of the present invention, the groove 27 is disposed on the side surfaces 215 as shown in FIG. 3. In different embodiments, the groove 27 is disposed on the second surface 213 of the insulating substrate as shown in FIG. 8. Additionally, the groove 27 shown in FIG. 3 and FIG. 8 does not penetrate the insulating substrate 21; in different embodiments, the groove 27 may penetrate the insulating substrate 21.

Figure 9:
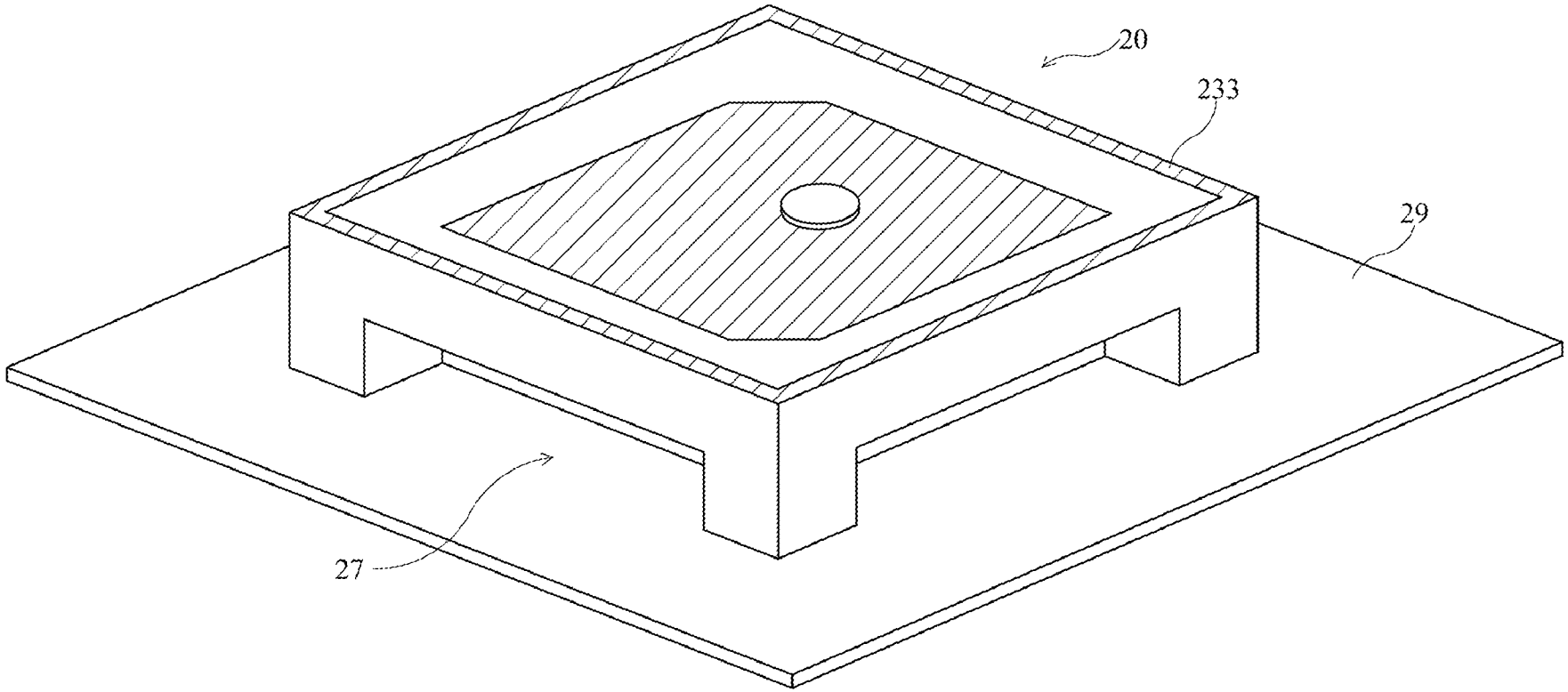
FIG. 9 is a stereoscopic diagram illustrating top of a multi-frequency antenna device according to another embodiment of the present invention.

One of features of the present invention is that the groove 27 is disposed on the second surface 213 and/or at least one side surface 215 of the insulating substrate 21, which allows the projection of the groove 27 on the first surface 211 to completely or partially overlap the second electrode layer 233 disposed on the first surface 211 of the insulating substrate 21. By arrangement of the groove 27, an effective dielectric constant of the media between the second electrode layer 233 and the third electrode layer 235 can be changed, and an effective dielectric constant between the second electrode layer 233 and a ground plane 29 under the multi-frequency antenna device 20 as shown in FIG. 9 (the multi-frequency antenna device 20 is disposed on the ground plane 29 (e.g. a ground plane on a circuit board)) can also be changed, so that the second resonance frequency generated by the second electrode layer 233 is changed; for example, the effective dielectric constants of the media between the second electrode layer 233 and the third electrode layer 235 and/or the ground plane 29 can be reduced by arrangement of the groove 27, and the second resonance frequency generated by the second electrode layer 233 can be increased.

Figure 10:
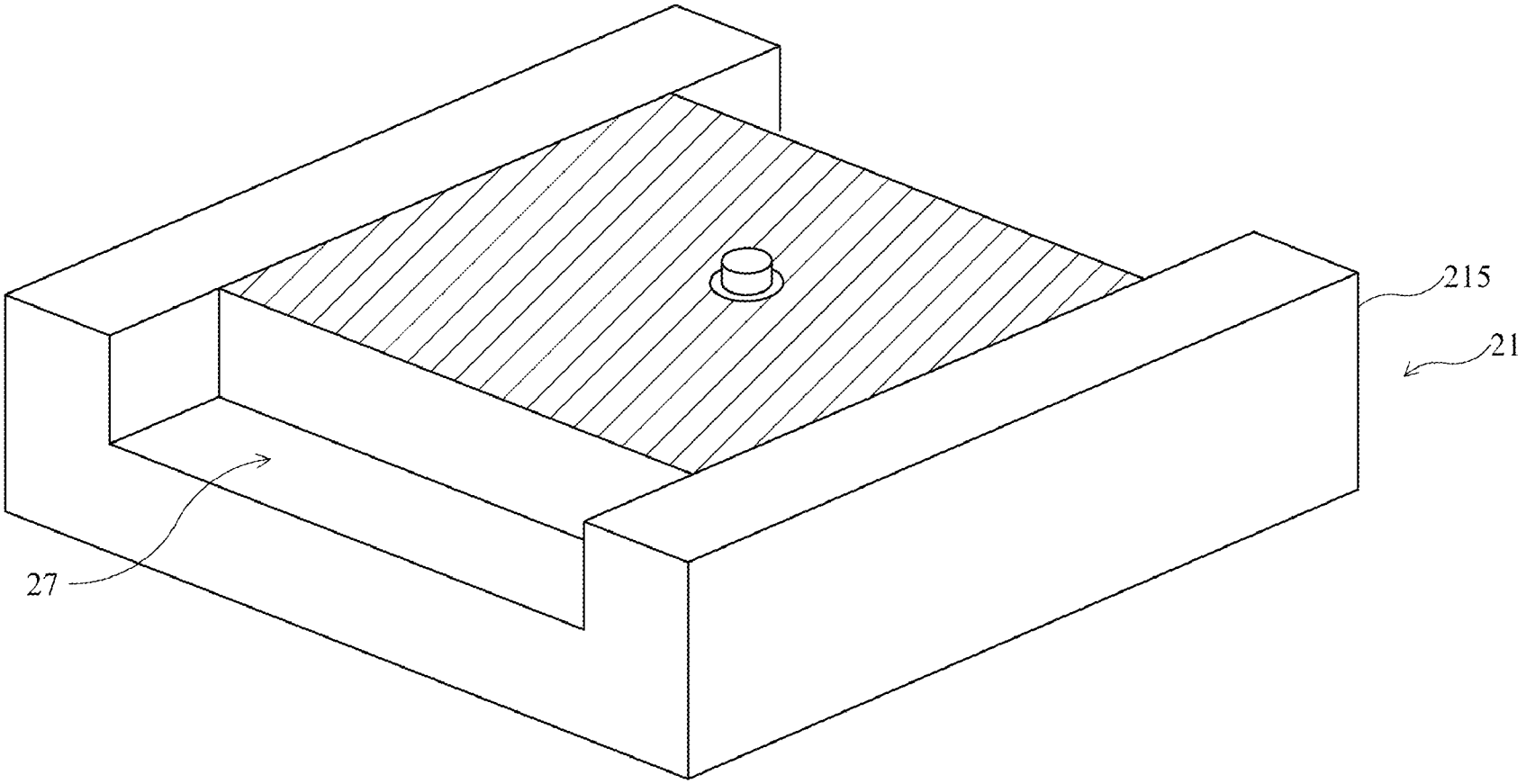
FIG. 10 is a stereoscopic diagram illustrating bottom of a multi-frequency antenna device according to another embodiment of the present invention.
Figure 11:
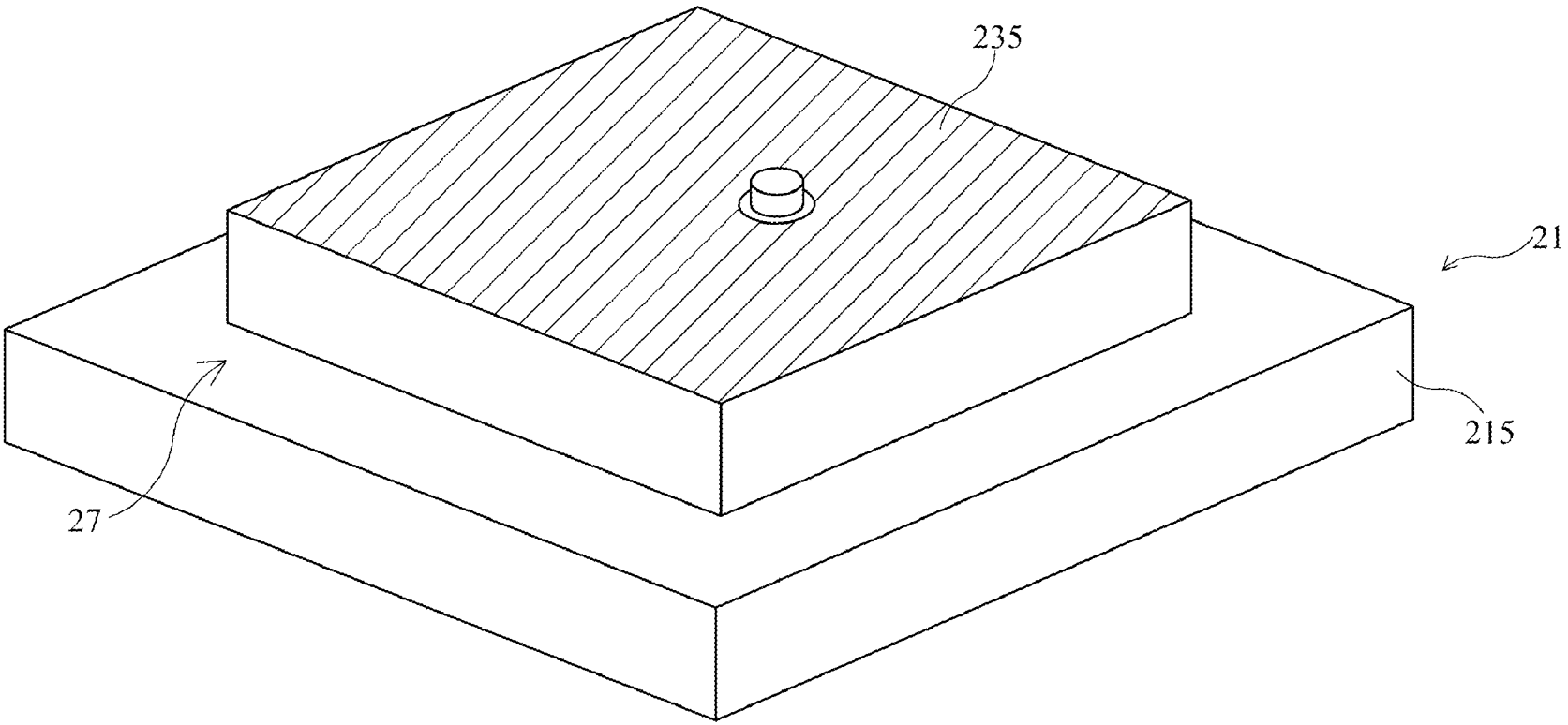
FIG. 11 is a stereoscopic diagram illustrating bottom of a multi-frequency antenna device according to another embodiment of the present invention.
Figure 12:
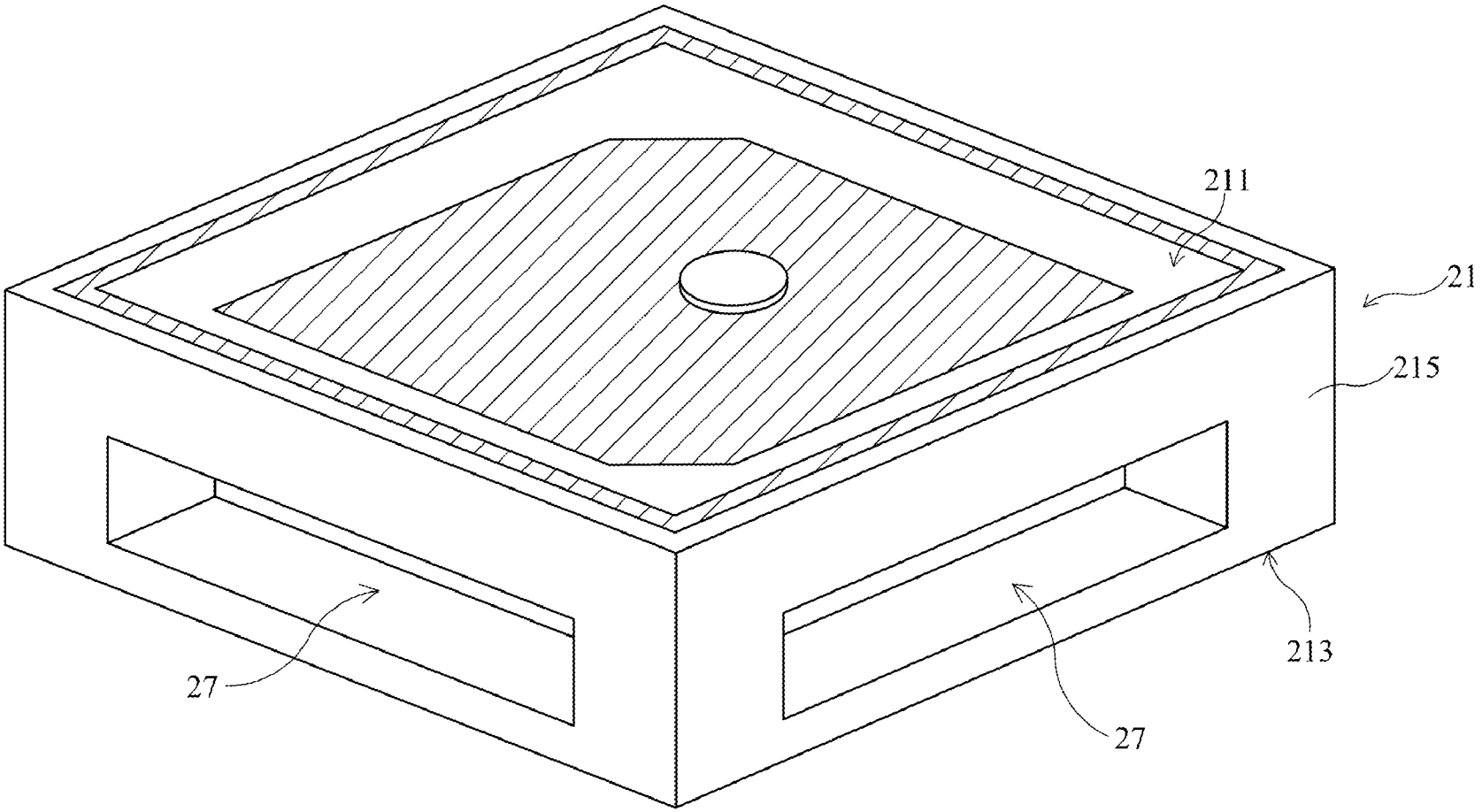
FIG. 12 is a stereoscopic diagram illustrating top of a multi-frequency antenna device according to another embodiment of the present invention.

In different embodiments, the location at which the groove 27 is disposed on the insulating substrate 21 can also be changed; for example, one or more grooves 27 are respectively disposed on the side surfaces 215 (such as all side surfaces 215) as shown in FIG. 3. Additionally, one or more grooves 27 may be disposed on a portion of the side surfaces 215 only, where each groove 27 is symmetrically disposed on the insulating substrate; for example, the grooves 27 are respectively disposed on opposite side surfaces 215 of the insulating substrate 21 as shown in FIG. 10. The groove 27 may also be disposed to surround the side surface 215 of the insulating substrate 21 as shown in FIG. 11. Additionally, the groove 27 may also be disposed on a portion or all of the side surfaces 215 of the insulating substrate 21, and the groove 27 does not extend to the first surface 211 and the second surface 213 of the insulating substrate 21 as shown in FIG. 12.

In practice, an overlapping area of the projection of the groove on the first surface 211 and the second electrode layer 233 can be changed, the vertical height of the groove 27 along the side surface 215 can be changed, and/or the location arrangement of the groove 27 can be changed, to adjust the second resonance frequency generated by the second electrode layer 233 to make the second resonance frequency conform to design requirement of the multi-frequency antenna device 20.

Figure 13:
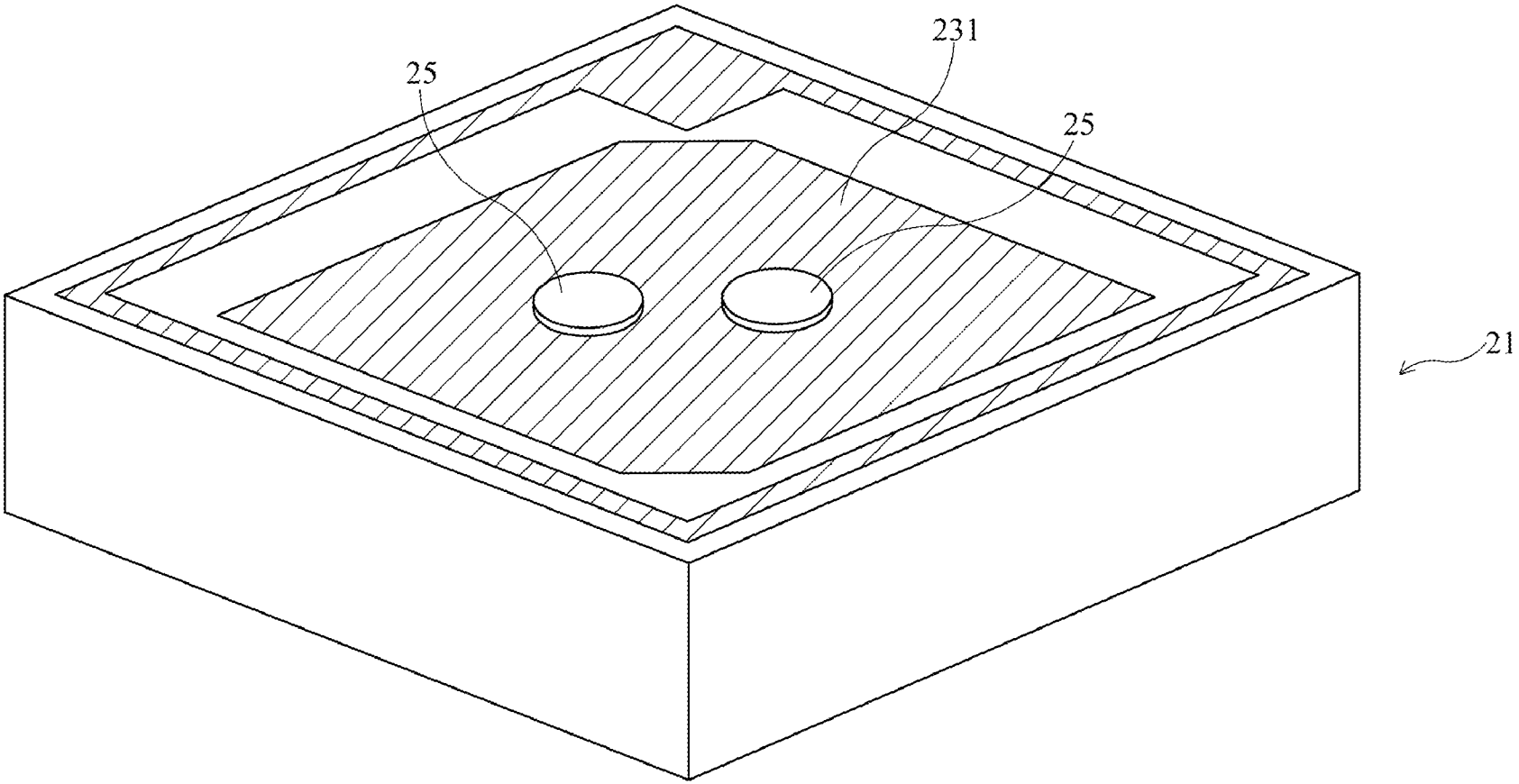
FIG. 13 is a stereoscopic diagram illustrating top of a multi-frequency antenna device according to another embodiment of the present invention.
Figure 14:
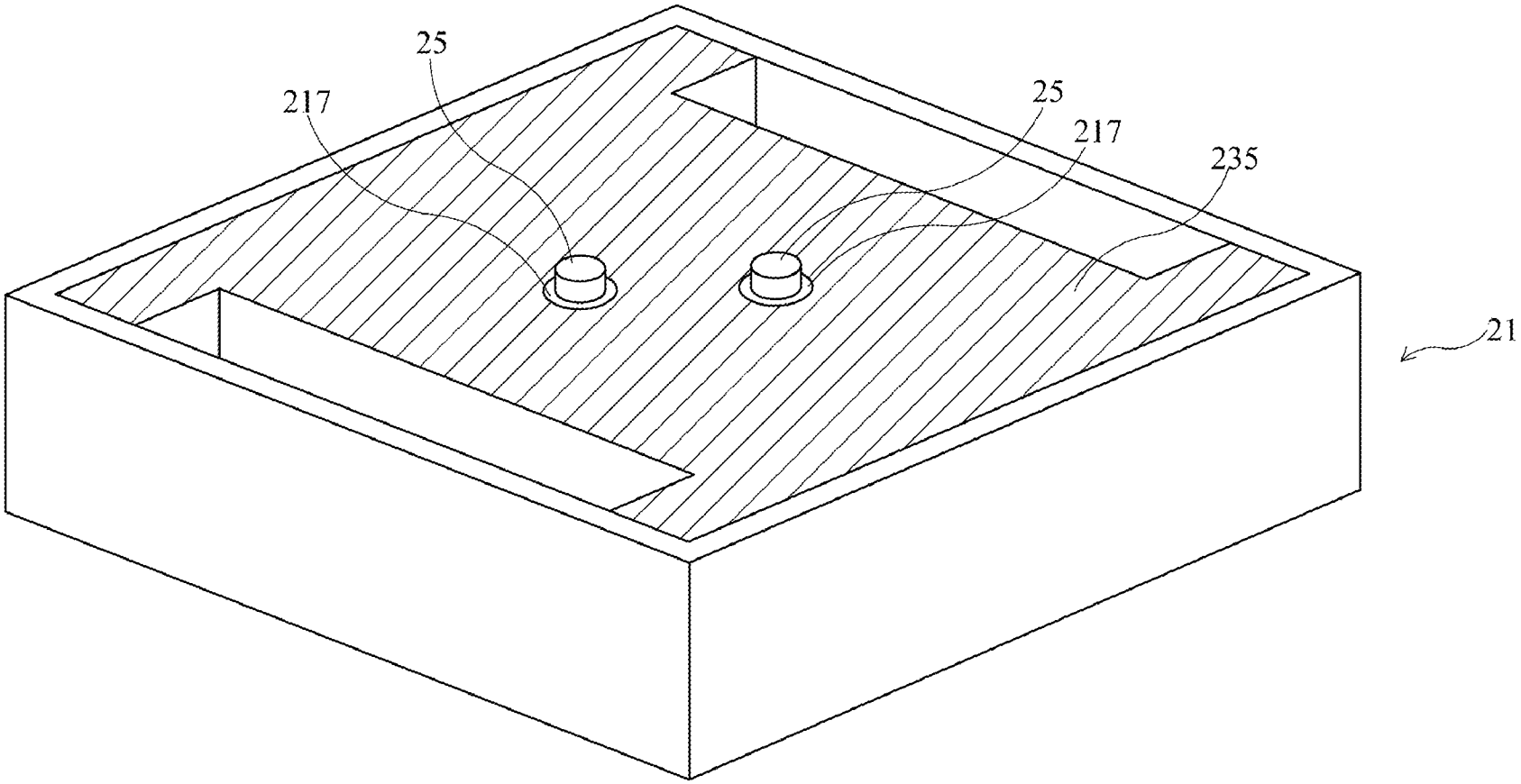
FIG. 14 is a stereoscopic diagram illustrating bottom of a multi-frequency antenna device according to another embodiment of the present invention.

In another embodiment of the present invention, the number of the first holes 217 on the insulating substrate 21 maybe two as shown in FIG. 13 and FIG. 14, where both two first holes 217 penetrate the insulating substrate 21, and two conductive elements 25 are respectively disposed in the two first holes 217, where each of the two conductive elements 25 is connected to the first electrode layer 231 and a signal feed-in terminal (not shown) without contacting the third electrode layer 235.

Figure 15:
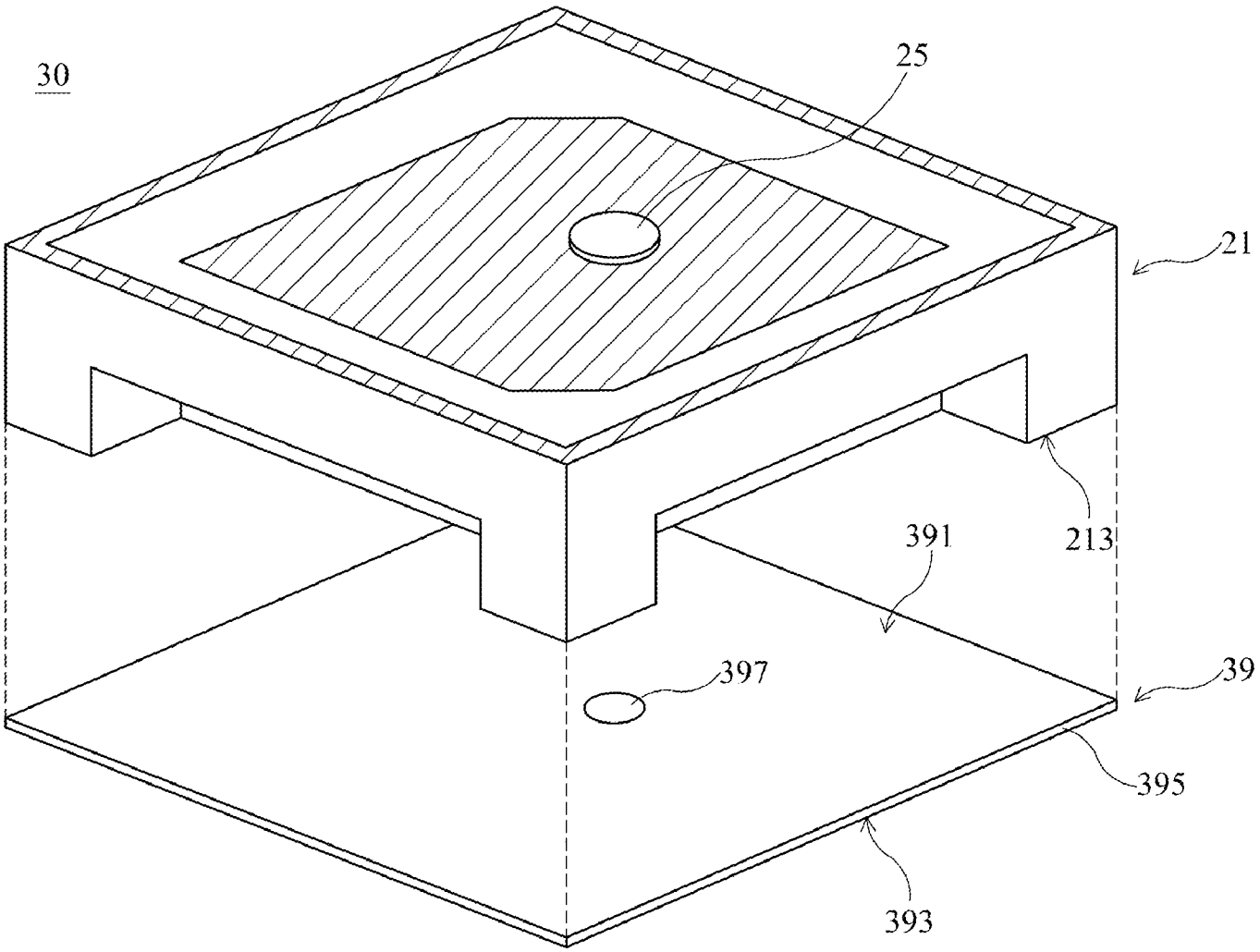
FIG. 15 is a stereoscopic decomposition diagram illustrating top of a multi-frequency antenna device according to another embodiment of the present invention.
Figure 16:
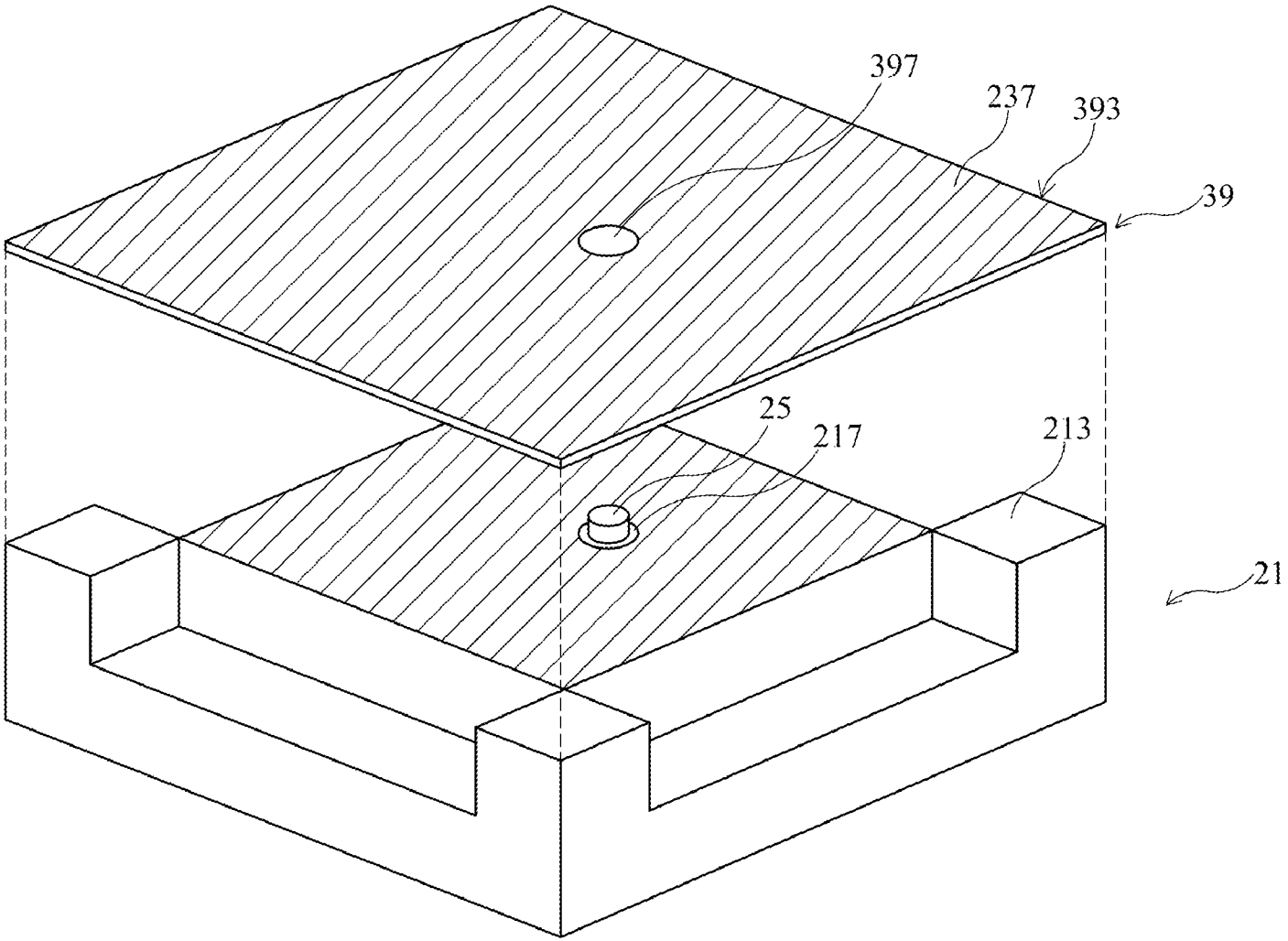
FIG. 16 is a stereoscopic decomposition diagram illustrating bottom of a multi-frequency antenna device according to another embodiment of the present invention.

Please refer to FIG. 15 and FIG. 16, which are stereoscopic decomposition diagrams respectively illustrating top and bottom of a multi-frequency antenna device 30 according to an embodiment of the present invention. The multi-frequency antenna device 30 in this embodiment is similar to the multi-frequency antenna device 20 in the aforementioned embodiment, where the main difference is that the multi-frequency antenna device 30 further comprises a carrier substrate 39. The carrier substrate 39 may be made of one or more insulating materials, and may be made of metal or conductive materials too. The carrier substrate 39 comprises a third surface 391, a fourth surface 393 and at least one side surface 395. The third surface 391 and the fourth surface 393 are opposite surfaces separated by the carrier substrate 39, and the third surface 391 is connected with the fourth surface 393 through the side surface 395.

The carrier substrate 39 comprises at least one second hole 397, where the second hole 397 penetrates the carrier substrate 39. The carrier substrate 39 adheres to the second surface 213 of the insulating substrate 21 through all or partial region of the third surface 391, where the second hole 397 of the carrier substrate 39 and the first hole 217 of the insulating substrate 21 are connected to each other, and the conductive element 25 penetrates the first hole 217 and the second hole 397.

In an embodiment of the present invention, a fourth electrode layer 237 may be disposed on the fourth surface 393 of the carrier substrate 39, but the present invention is not limited thereto.

Figure 17:
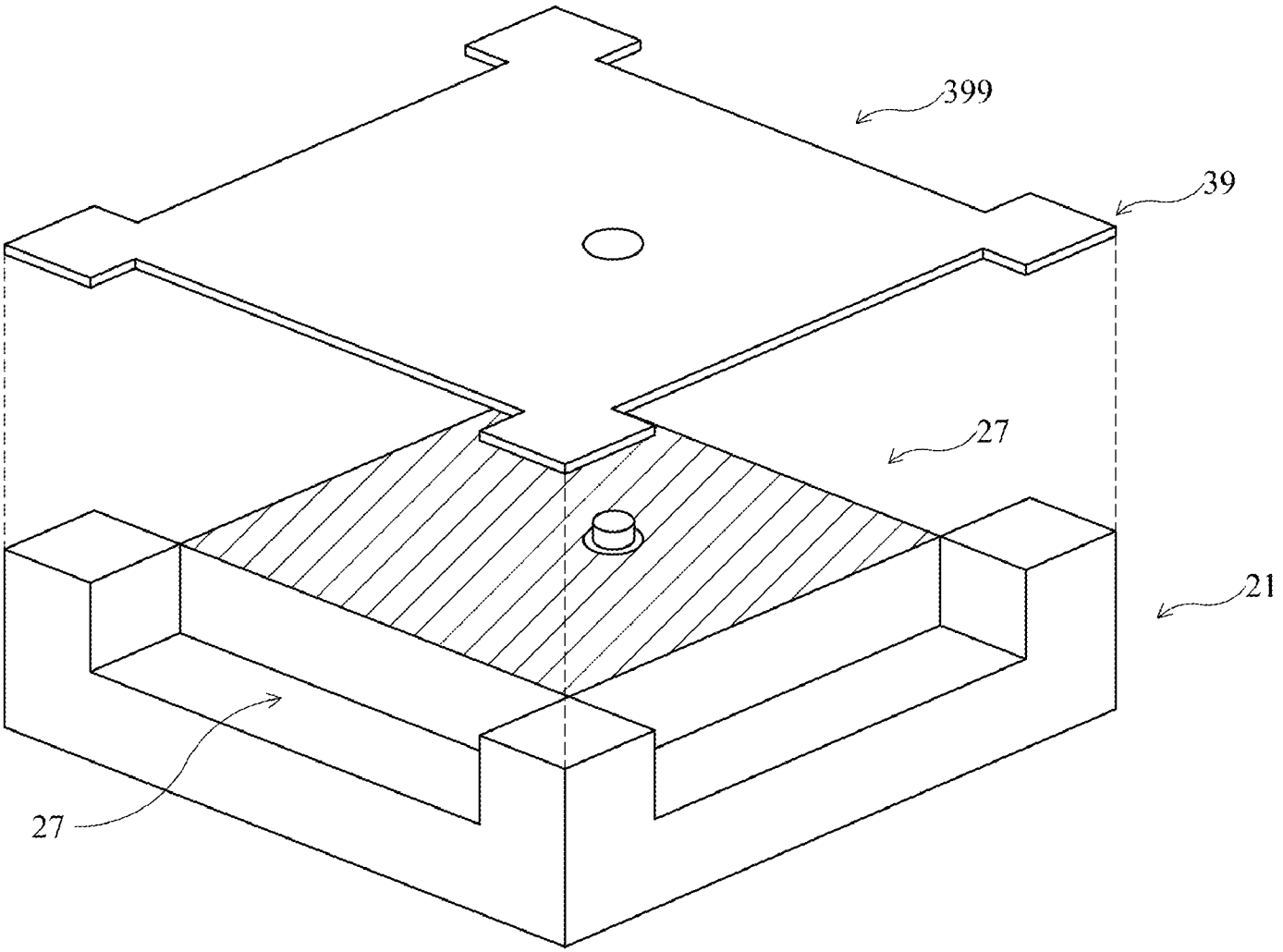
FIG. 17 is a stereoscopic decomposition diagram illustrating bottom of a multi-frequency antenna device according to another embodiment of the present invention.

In an embodiment of the present invention, the carrier substrate 39 may comprise at least one indented region 399 as shown in FIG. 17, where the indented region 399 of the carrier substrate 39 may partially or completely overlap the groove 27 on the insulating substrate 21, or does not overlap at all. Additionally, a cross-sectional area of the indented region 399 may be greater than, equal to, or less than the cross-sectional area of the groove 27.

In another embodiment of the present invention, the third electrode layer 235 and the fourth electrode layer 237 disposed on the multi-frequency antenna device 30 can be omitted, and more particularly, the multi-frequency antenna device 30 can generate two or more different resonance frequencies through the first electrode layer 231 and the second electrode layer 233 only.

Figure 18:
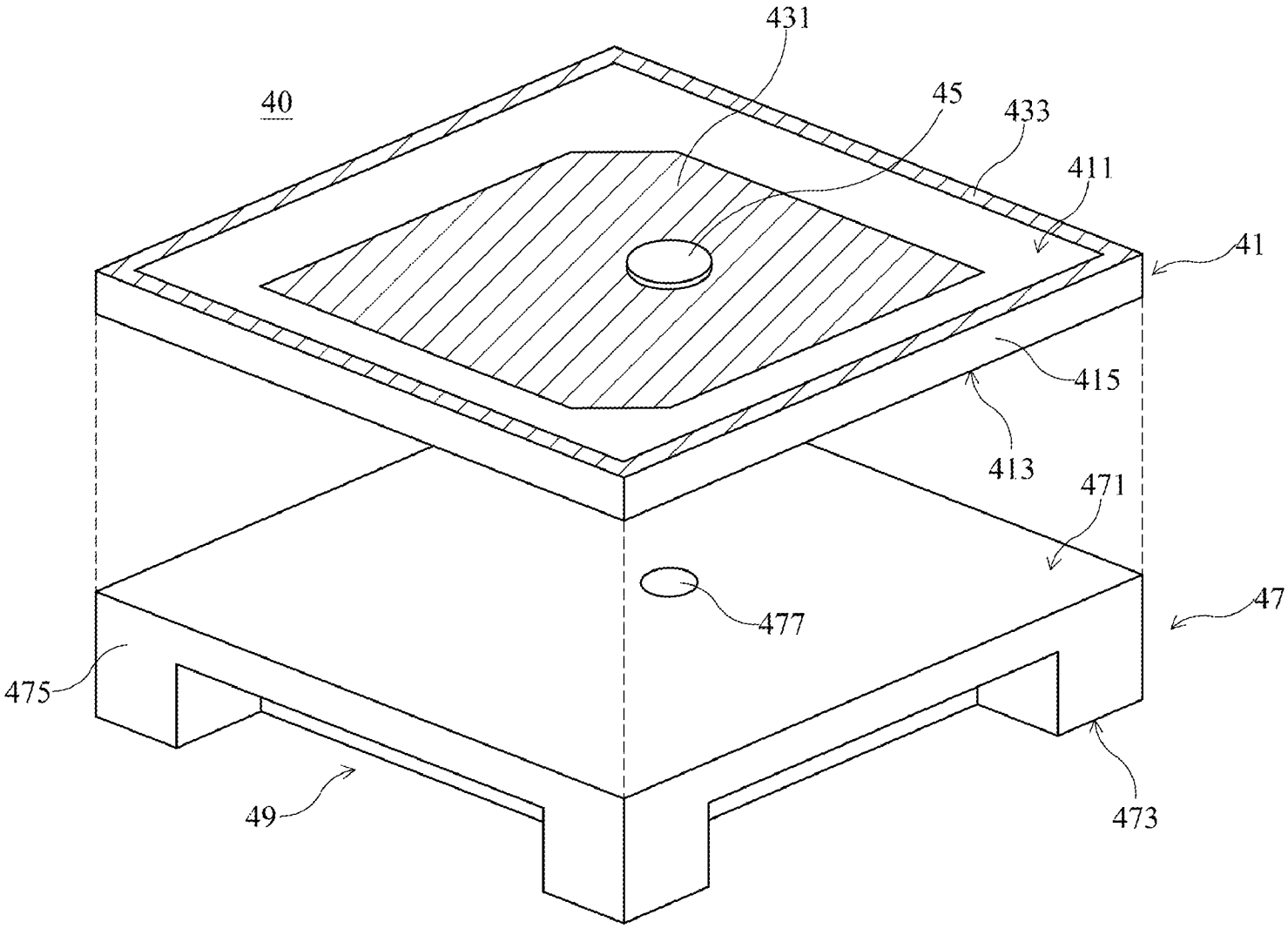
FIG. 18 is a stereoscopic decomposition diagram illustrating top of a multi-frequency antenna device according to another embodiment of the present invention.
Figure 19:
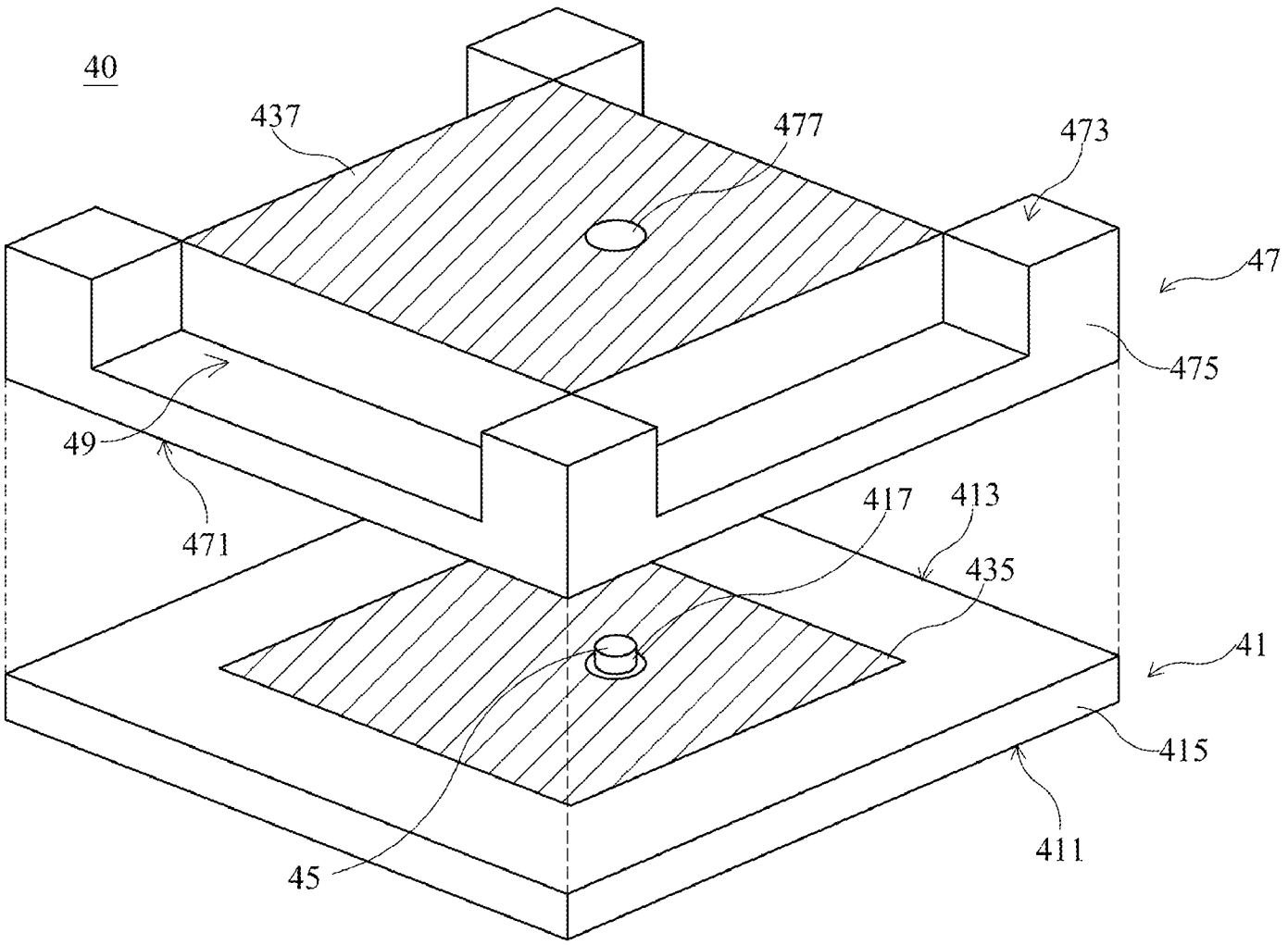
FIG. 19 is a stereoscopic decomposition diagram illustrating bottom of a multi-frequency antenna device according to another embodiment of the present invention.

Please refer to FIG. 18 and FIG. 19, which are stereoscopic decomposition diagrams respectively illustrating top and bottom of a multi-frequency antenna device 40 according to an embodiment of the present invention. As shown in FIG. 18 and FIG. 19, the multi-frequency antenna device 40 mainly comprises an insulating substrate 41, at least one first electrode layer 431, at least one second electrode layer 433, at least one third electrode layer 435, a carrier substrate 47, at least one conductive element 45 and at least one groove 49.

The insulating substrate 41 comprises a first surface 411, a second surface 413, at least one side surface 415 and at least one first hole 417, where the first surface 411 and the second surface 413 are opposite surfaces separated by the insulating substrate 41; for example, the first surface 411 is a top surface, and the second surface 413 is a bottom surface. Additionally, the first surface 411 is connected with the second surface 413 through the side surface 415, to make the insulating substrate 41 be a polygonal prism or a cylinder. The first hole 417 penetrates the insulating substrate 41; for example, the first hole 417 links up the first surface 411 and the second surface 413 of the insulating substrate 41.

The first electrode layer 431 and the second electrode 433 are disposed on the first surface 411 of the insulating substrate 41, where the second electrode layer 433 is located outside of a periphery of the first electrode layer 431 without contacting the first electrode layer 431.

The third electrode layer 435 is disposed on the second surface 413 of the insulating substrate 41, and is opposite to the first electrode layer 431 and/or the second electrode layer 433. The conductive element 45 penetrates the first hole 417 of the insulating substrate 41, and is electrically connected to the first electrode layer 431 without contacting the third electrode layer 435.

The carrier substrate 47 comprises a third surface 471, a fourth surface 473 and at least one side surface 475, where the third surface 471 and the fourth surface 473 are opposite surfaces separated by the carrier substrate 47. The third surface 471 is connected with the fourth surface 473 through the side surface 475, and the second hole penetrates the carrier substrate 47. All or partial region of the third surface of the carrier substrate 47 adheres to the second surface 413 of the insulating substrate 41, where the second hole 477 of the carrier substrate 47 is connected to the first hole 417 of the insulating substrate 41.

The conductive element 45 penetrates the first hole 417 and the second hole 477, and is electrically connected to the first electrode layer 431 without contacting the third electrode layer 435. The groove 49 is disposed on the side surface 475 and/or the third surface 471 and/or the fourth surface 473 of the carrier substrate 47, where the projection of the groove 49 on the first surface 411 completely or partially overlaps the second electrode layer 433. The first electrode layer 431 is arranged to generate a first resonance frequency, and the second electrode layer is arranged to generate a second resonance frequency, where the first resonance frequency is higher than the second resonance frequency. The number of the grooves 49 may be plural, and the grooves 49 may be symmetrically disposed on the side surface 475 and/or the third surface 471 and/or the fourth surface 473.

In an embodiment of the present invention, the carrier substrate may be insulating materials, and at least one fourth electrode layer 437 may be disposed on the fourth surface 473 of the carrier substrate 47, where the fourth electrode layer 437 does not contact the conductive element 45. Additionally, an area of the fourth electrode layer 437 is greater than an area of the third electrode layer 435. In another embodiment of the present invention, the carrier substrate maybe made of one or more metal materials, where the carrier substrate does not contact the conductive element 45. More specifically, when the carrier substrate 47 is made of the metal materials, there is no need for the additional fourth electrode layer 437.

In an embodiment of the present invention, the first electrode layer 431 does not contact the second electrode layer 433, and intervals having different distances between the first electrode layer 431 and the second electrode layer 433 is formed, where a top view is shown in FIG. 4. Additionally, the number of each of the first holes 417 and the second holes 477 may be two, where two first holes 417 are correspondingly connected to the two second holes 477, and two conductive elements 45 are respectively disposed in the two first holes 417 and the two second holes 477. A terminal of each of the two conductive elements 45 is connected to the first electrode layer 431 without contacting the third electrode layer 435, and another terminal of the aforementioned each of the two conductive elements 45 is connected to a signal feed-in terminal (not shown).

In another embodiment of the present invention, the third electrode layer 435 and/or the fourth electrode layer 437 disposed on the multi-frequency antenna 40 device can be omitted, and more particularly, the multi-frequency antenna 40 can generate two or more different resonance frequencies through the first electrode layer 431 and the second electrode layer 433 only. Additionally, at least one groove 49 may be disposed on the side surface 415 or the second surface 413 of the insulating substrate 41, or be disposed on the side surface 475 or the third surface 471 or the fourth surface 473 of the carrier substrate 47, to achieve a purpose of adjusting the resonance frequency generated by the multi-frequency antenna 40.

Figure 20:
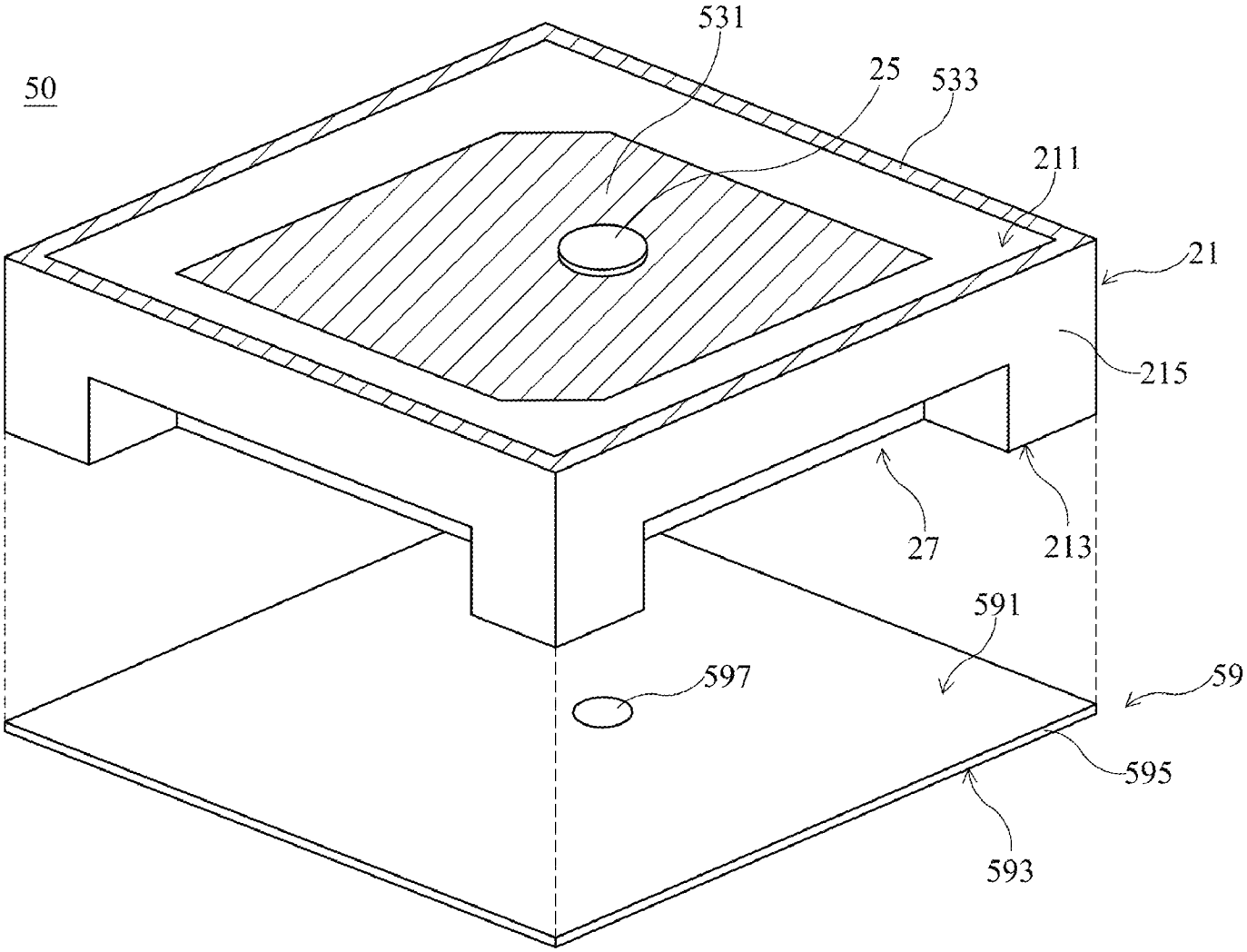
FIG. 20 is a stereoscopic decomposition diagram illustrating top of a multi-frequency antenna device according to another embodiment of the present invention.
Figure 21:
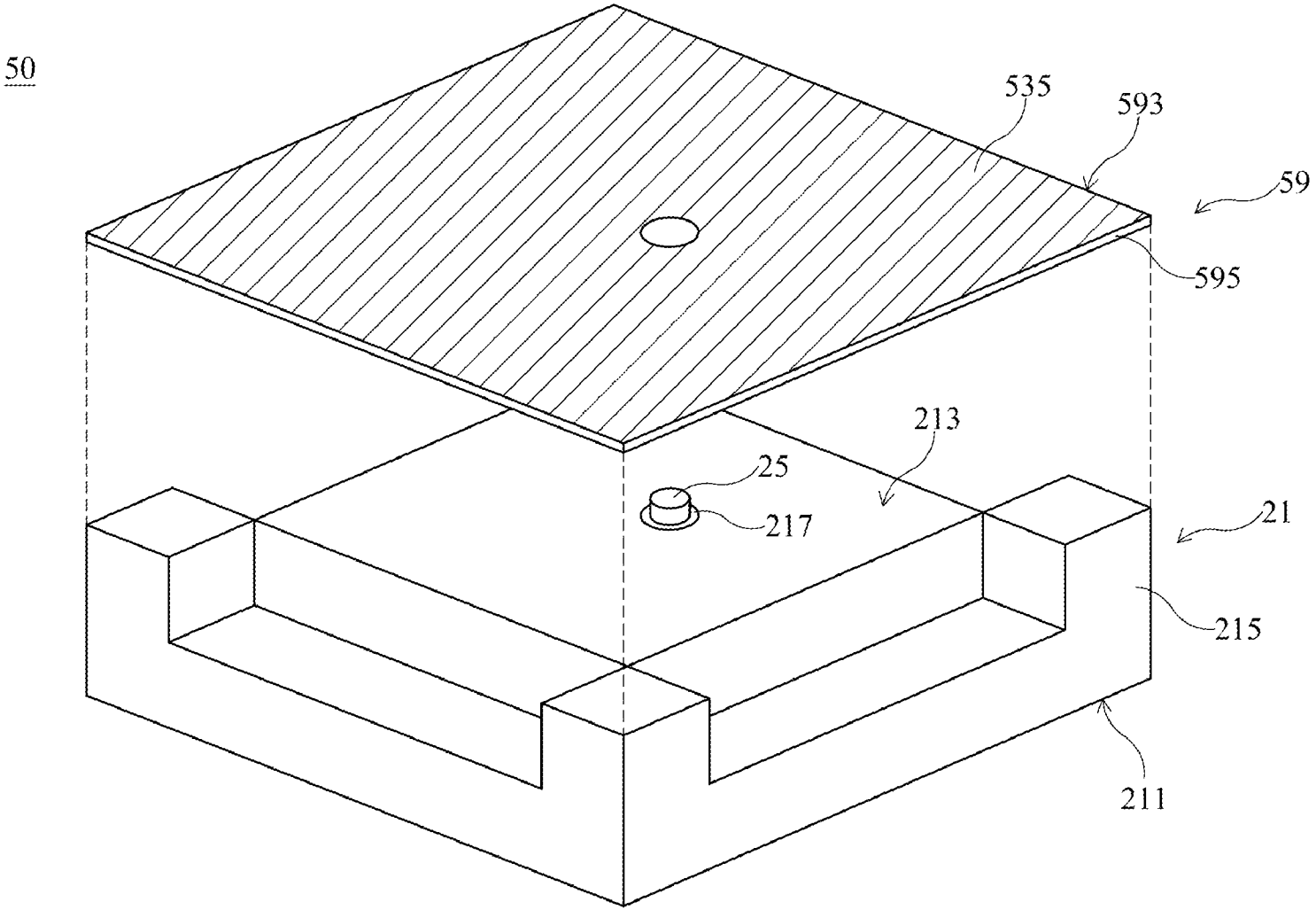
FIG. 21 is a stereoscopic decomposition diagram illustrating bottom of a multi-frequency antenna device according to another embodiment of the present invention.

Please refer to FIG. 20 and FIG. 21, which are stereoscopic decomposition diagrams respectively illustrating top and bottom of a multi-frequency antenna device 50 according to an embodiment of the present invention. As shown in FIG. 20 and FIG. 21, the multi-frequency antenna device 50 mainly comprises an insulating substrate 21, at least one first electrode layer 531, at least one second electrode layer 533, at least one conductive element 25, at least one groove 27 and a carrier substrate 59.

The insulating substrate 21 comprises a first surface 211, a second surface 213, at least one side surface 215 and at least one first hole 217, where the first surface 211 and the second surface 213 are opposite surfaces separated by the insulating substrate 21; for example, the first surface 211 is a top surface, and the second surface 213 is a bottom surface. Additionally, the first surface 211 is connected with the second surface 213 through the side surface 215, to make the insulating substrate 21 be a polygonal prism or a cylinder. The first hole 217 penetrates the insulating substrate 21; for example, the first hole 217 links up the first surface 211 and the second surface 213 of the insulating substrate 21.

The first electrode layer 531 and the second electrode layer 533 are disposed on the first surface 211 of the insulating substrate 21, where the second electrode layer 533 is located outside of a periphery of the first electrode layer 531 without contacting the first electrode layer 531.

The groove 27 is disposed on the side surface 215 and/or the second surface 213 of the insulating substrate 21, where a projection of the groove 27 on the first surface 211 completely or partially overlaps the second electrode layer 533. The first electrode layer 531 is arranged to generate a first resonance frequency, and the second electrode layer 533 is arranged to generate a second resonance frequency, where the first resonance frequency is higher than the second resonance frequency.

The carrier substrate 59 comprises a third surface 591, a fourth surface 593 and at least one side surface 595, where the third surface 591 and the fourth surface 593 are opposite surfaces separated by the carrier substrate 59, and the third surface 591 is connected with the fourth surface 593 through the side surface 595, where a second hole 597 penetrates the carrier substrate 59.

All or partial region of the third surface 591 of the carrier substrate 59 adheres to the second surface 213 of the insulating substrate 21, where the second hole 597 of the carrier substrate 59 is connected to the first hole 217 of the insulating substrate 21. The conductive element 25 penetrates the first hole 217 and the second hole 597, and is electrically connected to the first electrode layer 531. More specifically, the difference between this embodiment and that shown in FIG. 15 and FIG. 16 is that the second surface 213 of the insulating substrate 21 does not have any electrode layer built thereon.

In an embodiment of the present invention, the carrier substrate may be insulating materials, and at least one third electrode layer 535 may be disposed on the fourth surface 593 of the carrier substrate 59 without contacting the conductive element 25. In another embodiment of the present invention, the carrier substrate 59 may be made of one or more metal materials, where the carrier substrate 59 does not contact the conductive element 25. More specifically, when the carrier substrate 59 is made of the metal materials, there is no need for the additional third electrode layer 535.

Figure 22:
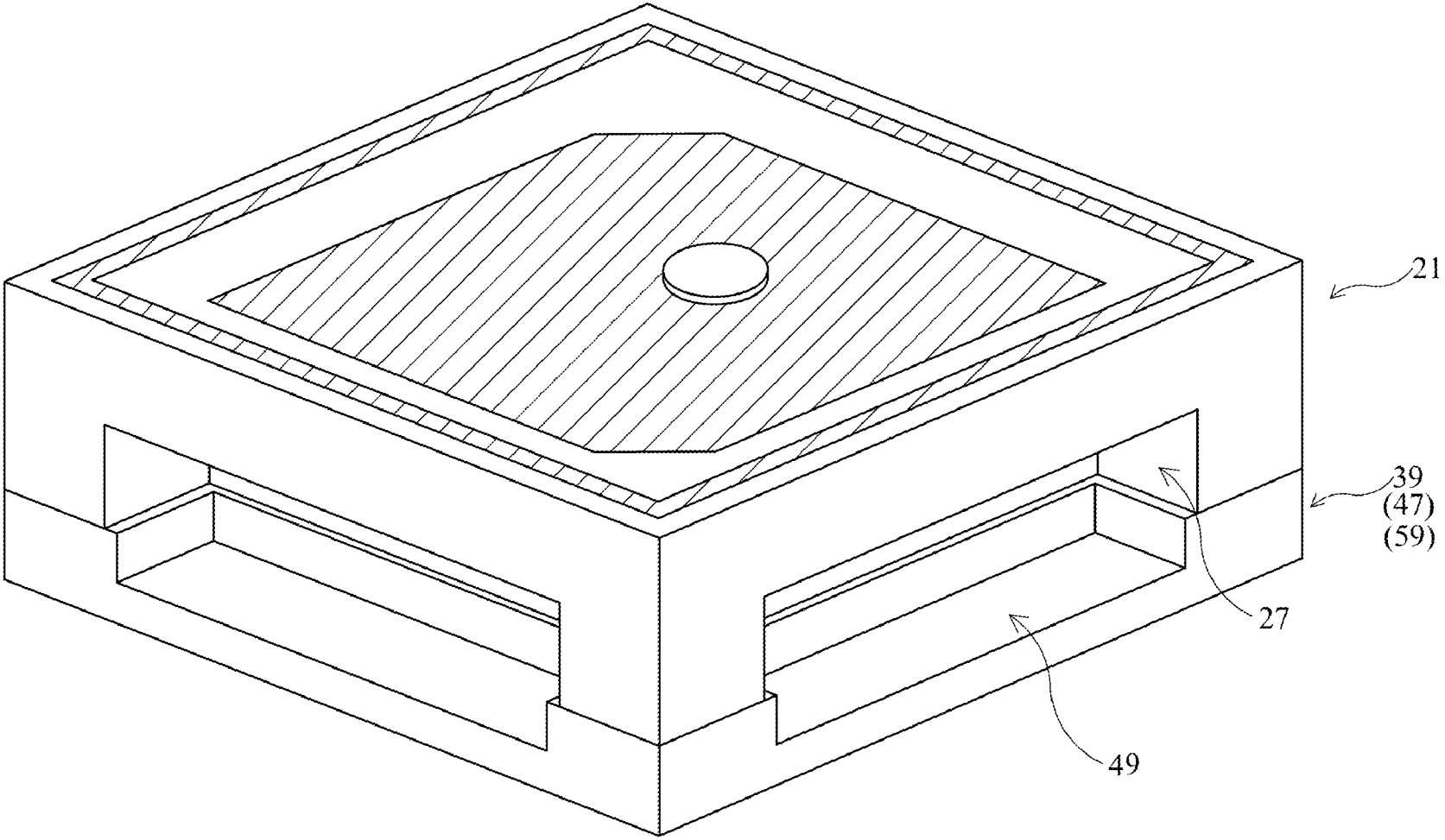
FIG. 22 is a stereoscopic diagram illustrating top of a multi-frequency antenna device according to another embodiment of the present invention.
Figure 23:
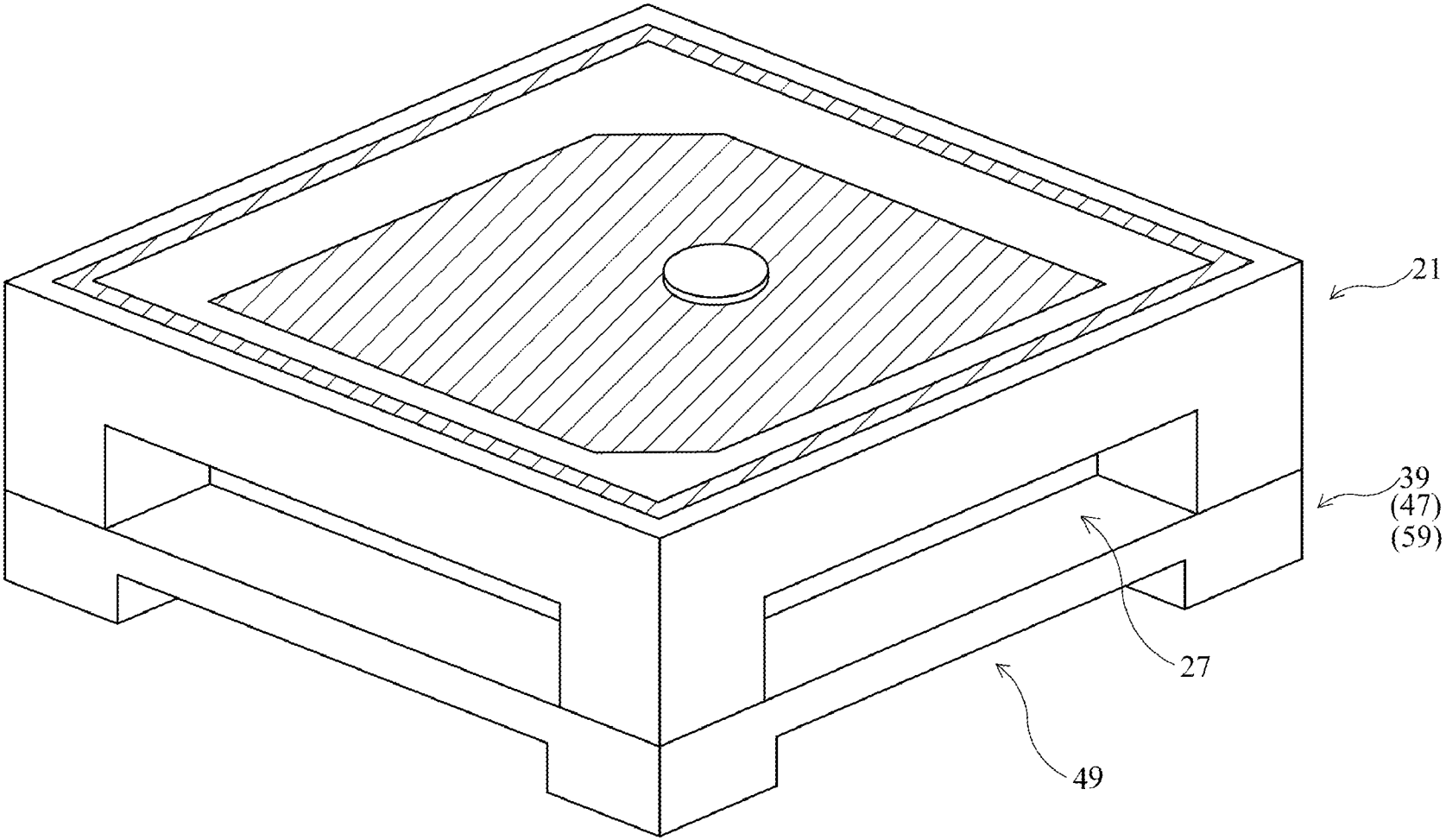
FIG. 23 is a stereoscopic diagram illustrating top of a multi-frequency antenna device according to another embodiment of the present invention.

In another embodiment of the present invention, in addition to the groove 27 disposed on the insulating substrate 21, the groove 49 may be disposed on the carrier substrate 39, 47 or 59, where the groove 49 of the carrier substrate 39, 47 or 59 may be in face to the groove 27 of the insulating substrate 21; for example, the groove 49 is disposed on the third surface of the carrier substrate 39, 47 or 59, so that the groove 49 of the carrier substrate 39, 47 or 59 is connected to the groove 27 of the insulating substrate 21 as shown in FIG. 22. The groove 49 may also be disposed on the fourth surface of the carrier substrate 39, 47 or 59, so that the groove 49 of the carrier substrate 39, 47 or 59 would be in the same direction as the groove 27 of the insulating substrate 21 as shown in FIG. 23. The groove 49 may also be disposed on the side surface only of the carrier substrate 39, 47 or 59.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-frequency antenna device, comprising:

an insulating substrate, comprising at least one first hole, a first surface, a second surface and at least one side surface, wherein the first surface and the second surface are opposite surfaces separated by the insulating substrate, the first surface is connected with the second surface through the side surface, and the first hole penetrates the insulating substrate;

at least one first electrode layer, disposed on the first surface of the insulating substrate;

at least one second electrode layer, disposed on the first surface of the insulating substrate, located outside of a periphery of the first electrode layer without contacting the first electrode layer;

at least one third electrode layer, disposed on the second surface of the insulating substrate;

at least one conductive element, penetrating the first hole and electrically connected to the first electrode layer without contacting the third electrode layer; and at least one groove, disposed on the side surface or the second surface of the insulating substrate, wherein a projection of the groove on the first surface completely or partially overlaps the second electrode layer, wherein the first electrode layer is arranged to generate a first resonance frequency, the second electrode layer is arranged to generate a second resonance frequency, and the first resonance frequency is higher than the second resonance frequency, wherein the groove is arranged to adjust an effective dielectric constant between the second electrode layer and the third electrode layer in order to adjust the second resonance frequency.

2. The multi-frequency antenna device of claim 1, wherein the groove is disposed to surround the side surface or the second surface of the insulating substrate.

3. The multi-frequency antenna device of claim 1, wherein the groove comprises a plurality of grooves that are symmetrically disposed on the side surface or the second surface of the insulating substrate.

4. The multi-frequency antenna device of claim 1, wherein the conductive element is electrically connected to a signal feed-in terminal.

5. The multi-frequency antenna device of claim 1, comprising a carrier substrate comprising a third surface, a fourth surface and at least one side surface, wherein the third surface and the fourth surface are opposite surfaces separated by the carrier substrate, the third surface is connected with the fourth surface through the side surface of the carrier substrate, and the third surface completely or partially adheres to the second surface of the insulating substrate, wherein the carrier substrate comprises at least one second hole penetrating the carrier substrate and connected to the first hole of the insulating substrate, and the conductive element penetrates the connecting first hole and second hole.

6. The multi-frequency antenna device of claim 5, wherein the carrier substrate is made of one or more insulating materials.

7. The multi-frequency antenna device of claim 6, wherein the carrier substrate comprises at least one indented region.

8. The multi-frequency antenna device of claim 5, wherein a fourth electrode layer is disposed on the fourth surface of the carrier substrate, and the conductive element does not contact the fourth electrode layer.

9. The multi-frequency antenna device of claim 5, wherein the carrier substrate is made of one or more metal materials, and the conductive element does not contact the carrier substrate.

10. The multi-frequency antenna device of claim 1, wherein four relative large sides of the first electrode layer and four adjacent sides of the second electrode layer respectively form four corresponding intervals, wherein within the four corresponding intervals, the smallest interval is a first interval, and the other intervals sequentially arranged in a clockwise direction are a second interval, a third interval and a fourth interval, wherein the first interval is not equal to the third interval, and the second interval is not equal to the fourth interval.

11. The multi-frequency antenna device of claim 1, wherein the insulating substrate comprises two first holes, the two first holes penetrate the insulating substrate, and said at least one conductive element comprises two conductive elements, wherein the two conductive elements are respectively disposed in the two first holes, and each of the two conductive elements is connected to the first electrode layer and a signal feed-in terminal without contacting the third electrode layer.

12. A multi-frequency antenna device, comprising:

an insulating substrate, comprising at least one first hole, a first surface and a second surface, wherein the first surface and the second surface are opposite surfaces separated by the insulating substrate, and the first hole penetrates the insulating substrate;

at least one first electrode layer, disposed on the first surface of the insulating substrate;

at least one second electrode layer, disposed on the first surface of the insulating substrate, located outside of a periphery of the first electrode layer without contacting the first electrode layer;

a carrier substrate, comprising at least one second hole, a third surface, a fourth surface and at least one side surface, wherein the third surface and the fourth surface are opposite surfaces separated by the carrier substrate, the third surface is connected with the fourth surface through the side surface of the carrier substrate, and the second hole penetrates the carrier substrate, wherein the third surface completely or partially adheres to the second surface of the insulating substrate, and the second hole is connected to the first hole of the insulating substrate;

at least one conductive element, penetrating the first hole and the second hole and electrically connected to the first electrode layer; and at least one groove, disposed on at least one side surface or the second surface of the insulating substrate, or disposed on the side surface, the third surface or the fourth surface of the carrier substrate, wherein a projection of the groove on the first surface completely or partially overlaps the second electrode layer, wherein the first electrode layer is arranged to generate a first resonance frequency, the second electrode layer is arranged to generate a second resonance frequency, and the first resonance frequency is higher than the second resonance frequency.

13. The multi-frequency antenna device of claim 12, comprising at least one third electrode layer that is disposed on the second surface of the insulating substrate, wherein the conductive element does not contact the third electrode layer.

14. The multi-frequency antenna device of claim 12, wherein the carrier substrate is made of one or more insulating materials.

15. The multi-frequency antenna device of claim 14, comprising at least one fourth electrode layer, disposed on the fourth surface of the carrier substrate, wherein the fourth electrode layer does not contact the conductive element.

16. The multi-frequency antenna device of claim 12, wherein the carrier substrate is made of one or more metal materials, and the carrier substrate does not contact the conductive element.

17. The multi-frequency antenna device of claim 12, wherein the conductive element is electrically connected to a signal feed-in terminal.

18. The multi-frequency antenna device of claim 12, wherein four relative large sides of the first electrode layer and four adjacent sides of the second electrode layer respectively form four corresponding intervals, wherein within the four corresponding intervals, the smallest interval is a first interval, and the other intervals sequentially arranged in a clockwise direction are a second interval, a third interval and a fourth interval, wherein the first interval is not equal to the third interval, and the second interval is not equal to the fourth interval.

19. The multi-frequency antenna device of claim 13, wherein the insulating substrate comprises two first holes, the carrier substrate comprises two second holes, and the two first holes of the insulating substrate are respectively connected with the two second holes of the carrier substrate, wherein said at least one conductive element comprises two conductive elements, each of the two conductive elements is disposed in one first hole and one second hole that are connected to each other, and said each of the two conductive elements is connected to the first electrode layer and a signal feed-in terminal without contacting the third electrode layer.

20. The multi-frequency antenna device of claim 15, wherein the insulating substrate comprises two first holes, the carrier substrate comprises two second holes, and the two first holes of the insulating substrate are respectively connected with the two second holes of the carrier substrate, wherein said at least one conductive element comprises two conductive elements, each of the two conductive elements is disposed in one first hole and one second hole that are connected to each other, and said each of the two conductive elements is connected to the first electrode layer and a signal feed-in terminal without contacting the fourth electrode layer.

* * * * *